US010557255B2

(12) United States Patent
Lee et al.

(10) Patent No.: US 10,557,255 B2
(45) Date of Patent: Feb. 11, 2020

(54) UNPOWERED AND AUTOMATICALLY FLUSHING TOILET SEAT, FOR WATER TANK, HAVING DETACHABLE AND WATERPROOF FUNCTIONS

(71) Applicants: AIR VOOM INC., Seoul (KR); Dong Jin Lee, Seoul (KR)

(72) Inventors: Dong Jin Lee, Seoul (KR); Jae Tong Lee, Seoul (KR)

(73) Assignees: AIR VOOM INC., Seoul (KR); Dong Jin Lee, Seoul (KR)

( * ) Notice: Subject to any disclaimer, the term of this patent is extended or adjusted under 35 U.S.C. 154(b) by 72 days.

(21) Appl. No.: 16/073,133

(22) PCT Filed: Jan. 24, 2017

(86) PCT No.: PCT/KR2017/000812

§ 371 (c)(1),
(2) Date: Jul. 26, 2018

(87) PCT Pub. No.: WO2017/131408

PCT Pub. Date: Aug. 3, 2017

(65) Prior Publication Data

US 2019/0040614 A1 Feb. 7, 2019

(30) Foreign Application Priority Data

Jan. 28, 2016 (KR) ..... 10-2016-0010458

(51) Int. Cl.
*E03D 5/04* (2006.01)
*A47K 13/24* (2006.01)

(52) U.S. Cl.
CPC ..... *E03D 5/04* (2013.01); *A47K 13/24* (2013.01)

(58) Field of Classification Search
CPC ..... E03D 5/04; A47K 13/24
USPC ..... 4/408
See application file for complete search history.

(56) References Cited

FOREIGN PATENT DOCUMENTS

| | | |
|---|---|---|
| KR | 100946393 | 3/2010 |
| KR | 101071981 | 10/2011 |
| KR | 20130109075 | 10/2013 |
| KR | 101389941 | 4/2014 |
| KR | 101487493 | 2/2015 |
| KR | 20150060647 | 6/2015 |
| KR | 20150060648 | 6/2015 |
| KR | 101535278 | 7/2015 |

OTHER PUBLICATIONS

International Search Report—PCT/KR2017/000812 dated May 10, 2017.

*Primary Examiner* — Christine J Skubinna
(74) *Attorney, Agent, or Firm* — Cantor Colburn LLP

(57) ABSTRACT

Provided is an unpowered and automatically flushing toilet seat, for a water tank, having detachable and waterproof functions. A loading lever rotates, for the descending movement of a toilet seat, and presses a loading member, thereby enabling enhancement of the transmission efficiency of the force and smooth operation. Since the loading member maintains the loaded state until a toilet paper time and flush control unit presses and releases the loading member, which has been moved and loaded by the pressing of the loading lever, a user can easily acquire time for discarding toilet paper.

47 Claims, 21 Drawing Sheets

UNPOWERED AND AUTOMATICALLY FLUSHING TOILET SEAT, FOR WATER TANK, HAVING DETACHABLE AND WATERPROOF FUNCTIONS

TECHNICAL FIELD

The present invention relates generally to an unpowered and automatically flushing toilet seat for a water tank. More particularly, the present invention relates to an unpowered and automatically flushing toilet seat, for a water tank, having detachable and waterproof functions, in which since a loading lever presses a loading member while being rotated due to the downward movement of the toilet seat, the power transfer efficiency is improved, thereby facilitating the operation, also until a toilet paper time and flush control unit presses the loading member loaded by being moved by pressure of the loading lever to unload the same, the loaded state of the loading member is maintained, whereby it is possible to easily secure a time for a user to discard toilet paper, and a loading unit and a toilet paper time and flush control unit, or the loading unit, the toilet paper time and flush control unit and the toilet paper time and flush control unit, or the loading unit, the toilet paper time and flush control unit, the feces and urine distinguishing unit and the toilet paper time and flush control unit are modularized, thereby simplifying the installation work to the toilet seat, and thus working process and working time can be reduced.

BACKGROUND ART

In general, a toilet is designed to discharge excreta with washing water supplied when a lever is operated to a sewage disposal tank after a user uses an indoor toilet, and recently, a "Device for non-power auto-flush of chamber pot" that automatically flushes using water pressure has been disclosed in Korean Patent No. 10-0946393.

According to this patent document, when a user sits on a toilet seat, water is supplied to an operation unit from a water tank through a water pipe opened by the weight of the user, a cylinder rod is pressed and moved while compressing a spring by the pressure of the water supplied to the operation unit, and the water moving the cylinder rod is supplied to a flushing unit by restoring force of the compressed spring, whereby flushing water corresponding to the excrement is discharged and removes the excrement.

However, according to the patent document, when the pressure of the water supplied from a hydrant is lower than the tension of the spring, the cylinder is not pressed and moved, it is difficult to determine whether the waste from the user is urine or feces and flushing is not appropriately performed, whereby automatic flushing function is lost, and thus the reliability of the product is deteriorated.

Further, when excrement is simultaneously discharged from a plurality of toilets, water pressure is weakened as the water is supplied to the toilets, so the cylinder rod cannot be moved to the position where excreta is determined and flushing water for urine is discharged. Accordingly, the toilets are clogged with remaining excreta or an offensive odor is caused. Further, it is troublesome to have to flush by manually operating the lever to remove the remaining excreta, and water is wasted and economic feasibility is low, and there is sanitation problem.

Further, the operation unit that is operated by water pressure is complicated, so productivity is low and manufacturing cost is increased, resulting in low economic feasibility, and there are many parts, so water leaks at their joints or dirt is accumulated in the pipes, which causes malfunction.

Recently, to solve the above problems, in the document of Korean Patent No. 10-1071981, there has been disclosed an "Automatically flushing toilet seat by distinguishing feces and urine only using energy of body weight".

According to this document, when a user sits on the toilet seat, the toilet seat is moved down by the weight of the user, the gap between first and second loading rollers decreases, tension of a loading wire is removed, and simultaneously, when a separation member fixed to a loading wire-fixing member is moved by the downward movement of the toilet seat to press an excreta determining unit, the excreta is determined as urine, and when a cylinder rod presses the excreta determining unit, the excreta is determined as feces, and in this state, when the user stands up from the toilet seat, the amount of fluid is adjusted in accordance with opening/closing of a hole depending on the determined urine or feces, the toilet seat is returned, the gap between the first and second loading rollers is increased, and the loading wire is tensed and pulls the flushing wire, so flushing water corresponding to the excreta is discharged into the toilet body and removes the excreta.

However, according to this configuration, when fluid is supplied to a cylinder in accordance with the weight of the user who sits on and stands up from the toilet seat, the fluid flows through a complicated system and there are many parts, so assembling is difficult and the manufacturing cost is high, which lowers economic feasibility.

Further, maintenance is difficult and a defective proportion is high due to possibility of leaking of the fluid at the joints of the parts, and the operation time depends on the amount of injected oil and a viscosity difference according to a temperature difference, so malfunction frequently occurs. Furthermore, water is not supplied or keeps being supplied due to an on/off error of a separate pipe valve, so reliability of the product is deteriorated.

To solve the above problems, in the document of Korean Patent No. 10-1389941, there has been disclosed a "Powerless automatic flushing toilet seat for water tank having air exhaust and intake control functions only through human body weight and powerless automatic flushing toilet seat for water tank".

According to this document, when the user sits on the toilet seat, the loading member should have a loading force that pulls the flushing wire in conjunction with the downward movement of the toilet seat, and when the user stands up from the toilet seat, the flushing wire pulled in conjunction with the upward movement of the toilet seat rotates the siphon cover upward, and at the same time the flushing water of the tank is discharged to the toilet main body through the opened drain hole, thereby removing excreta, and the amount of air sucked into the toilet paper time adjuster is controlled to adjust the operation time of flushing, thereby solving the problem of the conventional art.

However, according to the document, it is problematic in that the loading force that can pull the flushing wire is held by the loading member by the downward movement of the toilet seat, but as the lever is rotated, friction and load occur in the loading wire pulling the loading member, the power transmission efficiency is lowered so that the siphon cover cannot be lifted sufficiently, whereby the flushing water stored in the tank is not smoothly discharged and the power to remove the excreta is decreased. In addition, the toilet main body is left with a remaining excreta or foreign substances, which causes clogging of the toilet or offensive odor, so reliability of the product is deteriorated.

Further, the siphon cover should be lifted sufficiently to smoothly discharge the flushing water, but due to the height of the toilet seat, inconvenience for the users may be caused and there are design limitations, and as the number of parts increases, assembling is difficult, which increases the working time and increases the manufacturing cost, which lowers economic feasibility.

Recently, to solve the above problems, in the document of Korean Patent No. 10-1535278, there has been disclosed a "Powerless automatic flushing device with a loading-pressing protrusion having flushing function maximized with lowest human body weight and minimal seating switch action".

According to this document, the air in the guide rib is discharged outside in conjunction with the downward movement of the toilet seat by the user's body weight, and simultaneously, the loading member is rotated by pressure of the pressing protrusion to obtain a loading force to pull the flushing wire, and when the user's body weight is unloaded, the amount of air flowing in the guide rib is adjusted such that a time for a user to discard toilet paper is adjusted. In addition, as the flushing wire is pulled by the restoring force of the loading member, the flushing water in the tank is discharged to the toilet main body through the drain hole opened by the upward movement of the siphon cover and removes the excreta, thereby solving the problem of the conventional art.

However, according to the document, it is problematic in that since the loading member is rotated by pressure of the pressing protrusion to load a force to pull the flushing wire, when the loading member is rotated by the vertical movement of the pressing protrusion, operation is not smoothly performed due to the frictional force between the pressing protrusion and the loading member and parts may be damaged, thus maintenance is difficult, and in order to rotate the loading member, the user's body weight to move the pressing protrusion should be heavy for smooth operation.

Further, when the opening and closing member is operated by the loading force of the loading member, the loading member releases operation of the opening and closing member while being moved along the release member, but since the loading member is moved while being brought in close contact with the inclined release member, operation is not smoothly performed due to the frictional force between the loading member and the release member, and parts may be damaged, thus maintenance is difficult.

Further, the amount of air inflow is adjusted in accordance with the degree of compression of the adjustment filter by the pressure of the adjusting bolt, but the adjustment filter has a problem in that the adjustment amount is changed by the fine dust to be filtered or may be clogged and not restored, causing erroneous operation of continuous flushing, and since the members for implementing flushing are constituted by respective parts and assembled to the toilet seat, the work process is complicated, and the working time is increased and the labor cost is increased, which lowers economic feasibility.

Further, after assembling each part on the bottom plate of the toilet seat, each part should be waterproofed in the process of covering the top plate, but the waterproof condition is bad because the area where each part is installed is wide, and in case of service or repair, it is difficult to deal with, and also excreta and foreign substances enter into the seating switch during use, resulting in offensive odor and malfunction.

DISCLOSURE

Technical Problem

Accordingly, the present invention has been made keeping in mind the above problems occurring in the related art, and one object of the present invention is to provide an unpowered and automatically flushing toilet seat, for a water tank, having detachable and waterproof functions, in which since a loading lever presses a loading member while being rotated due to the downward movement of the toilet seat, the power transfer efficiency improve, thereby facilitating the operation, also the loading member is pressed in conjunction with the downward movement of the toilet seat to obtain a loading force to pull a flushing wire, and the loading member restored in conjunction with the upward movement of the toilet seat pulls the flushing wire such that flushing water in the tank is smoothly discharged to a toilet main body, whereby it is possible to increase cleaning power for excreta.

Further, another object of the present invention is to provide an unpowered and automatically flushing toilet seat, for a water tank, having detachable and waterproof functions, in which the air in a toilet paper time and flush control unit is discharged in conjunction with the downward movement of the toilet seat, and the amount of air flowing in the toilet paper time and flush control unit is adjusted in conjunction with the upward movement of the toilet seat, whereby it is possible to maintain the loaded state of the loading member until the loading member loaded by being moved by the pressure of the loading lever is unloaded by the pressure of the toilet paper time and flush control unit, and thus, it is possible to secure a time for the user to discard toilet paper.

Further, a further object of the present invention is to provide an unpowered and automatically flushing toilet seat, for a water tank, having detachable and waterproof functions, in which foreign substances contained in the air flowing in the toilet paper time and flush control unit are filtered by a fine adjustment filter, whereby it is possible to prevent malfunction due to clogging of the adjustment filter.

Further, still another object of the present invention is to provide an unpowered and automatically flushing toilet seat, for a water tank, having detachable and waterproof functions, in which the loading unit, or the loading unit and the toilet paper time and flush control unit, or the loading unit, the feces and urine distinguishing unit and the toilet paper time and flush control unit are modularized, thereby simplifying the installation work to the toilet seat, and thus working process and working time can be reduced, and also it is possible to prevent offensive odor and error by blocking the entrance of excreta and foreign substances into the seating switch by wrapping the seating switch with a waterproof member.

Technical Solution

In order to achieve the above object, according to some aspects of the present invention, there is provided an unpowered and automatically flushing toilet seat, for a water tank, having detachable and waterproof functions, the toilet seat including:

a seating switch configured to guide downward movement of a toilet seat by a sitting user's body weight, and to guide upward movement of the toilet seat when the user stands up from the toilet seat and the user's body weight is unloaded;

a loading unit configured to press a loading member in conjunction with the downward movement of the toilet seat so as to obtain a loading force to pull a flushing wire of an opening and closing member, and to pull the flushing wire of the opening and closing member in conjunction with the downward movement of the toilet seat by the loading force of the restoring loading member when the user's body weight is unloaded;

the opening and closing member configured to supply flushing water of a water tank to a toilet main body through a drain hole opened while a siphon cover is rotated upward by the flushing wire pulled by the loading force of the loading member to remove excreta, and to allow the siphon cover being rotated downward to close the drain hole when the loading force of the loading member is released; and a flushing-maintaining unit configured to maintain operation of the opening and closing member until set water is discharged while preventing abrupt restoration of the restoring loading member.

Advantageous Effects

According to the present invention, it is advantageous in that since a loading lever presses a loading member while being rotated due to the downward movement of the toilet seat, the power transfer efficiency is improved, thereby facilitating the operation, whereby it is possible to work smoothly even with a lightweight user like a child, and thus the reliability of the product is improved.

According to the present invention, it is further advantageous in that the loading member is pressed in conjunction with the downward movement of the toilet seat to obtain a loading force to pull a flushing wire, and the loading member restored in conjunction with the upward movement of the toilet seat pulls the flushing wire such that flushing water in the tank is smoothly discharged to a toilet main body, whereby it is possible to increase cleaning power for excreta, and it is possible to eliminate the cause of the offensive odor generated by the remaining excreta.

According to the present invention, it is further advantageous in that the air in a toilet paper time and flush control unit is discharged in conjunction with the downward movement of the toilet seat, and the amount of air flowing in the toilet paper time and flush control unit is adjusted in conjunction with the upward movement of the toilet seat, whereby it is possible to maintain the loaded state of the loading member until the loading member loaded by being moved by the pressure of the loading lever is unloaded by the pressure of the toilet paper time and flush control unit, and thus, it is possible to secure a time for the user to discard toilet paper.

According to the present invention, it is further advantageous in that foreign substances contained in the air flowing in the toilet paper time and flush control unit are filtered by a fine adjustment filter, whereby it is possible to use the adjustment filter stably while preventing malfunction due to clogging of the same.

According to the present invention, it is further advantageous in that the loading unit, or the loading unit and the toilet paper time and flush control unit, or the loading unit, the feces and urine distinguishing unit and the toilet paper time and flush control unit are modularized, thereby simplifying the installation work to the toilet seat, and thus working process and working time can be reduced, and also it is possible to prevent offensive odor and error by blocking the entrance of excreta and foreign substances into the seating switch by wrapping the seating switch with a waterproof member, whereby it is possible to prevent offensive odor and error occurrence.

DESCRIPTION OF REFERENCE CHARACTERS OF IMPORTANT PARTS

Figure 1:
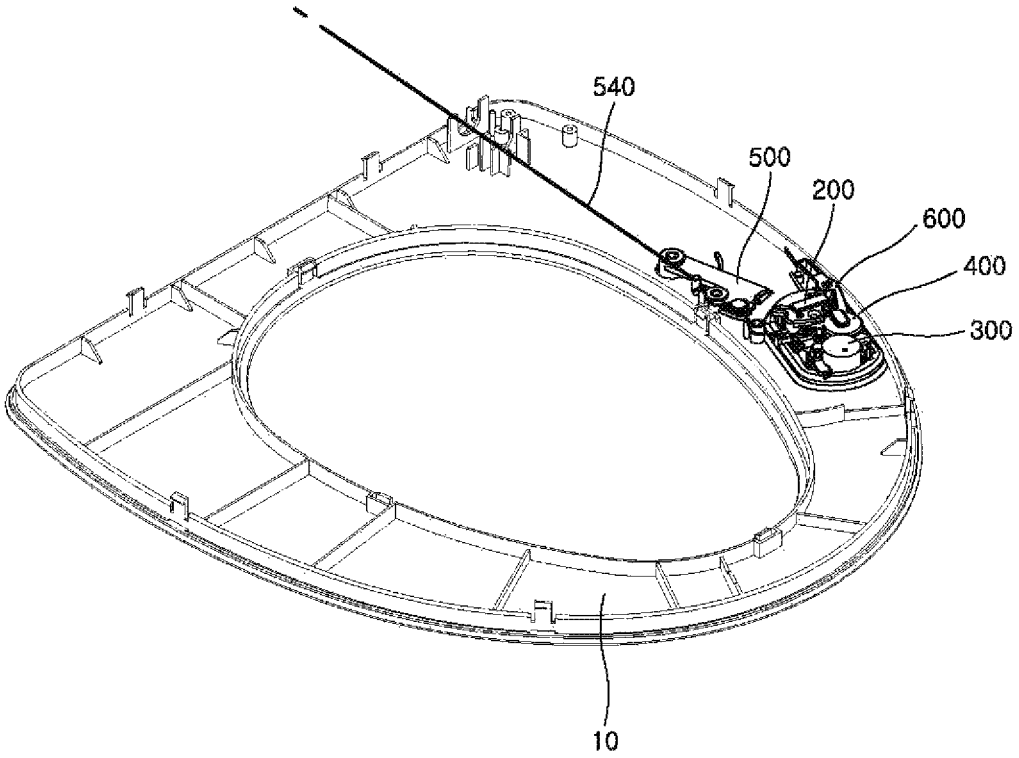
FIG. 1 is a perspective view showing the present invention.

100: seating switch
200: loading unit
300: feces and urine distinguishing unit
400: toilet paper time and flush control unit
500: opening and closing member
600: flushing-maintaining unit

BEST MODE

Figure 2:
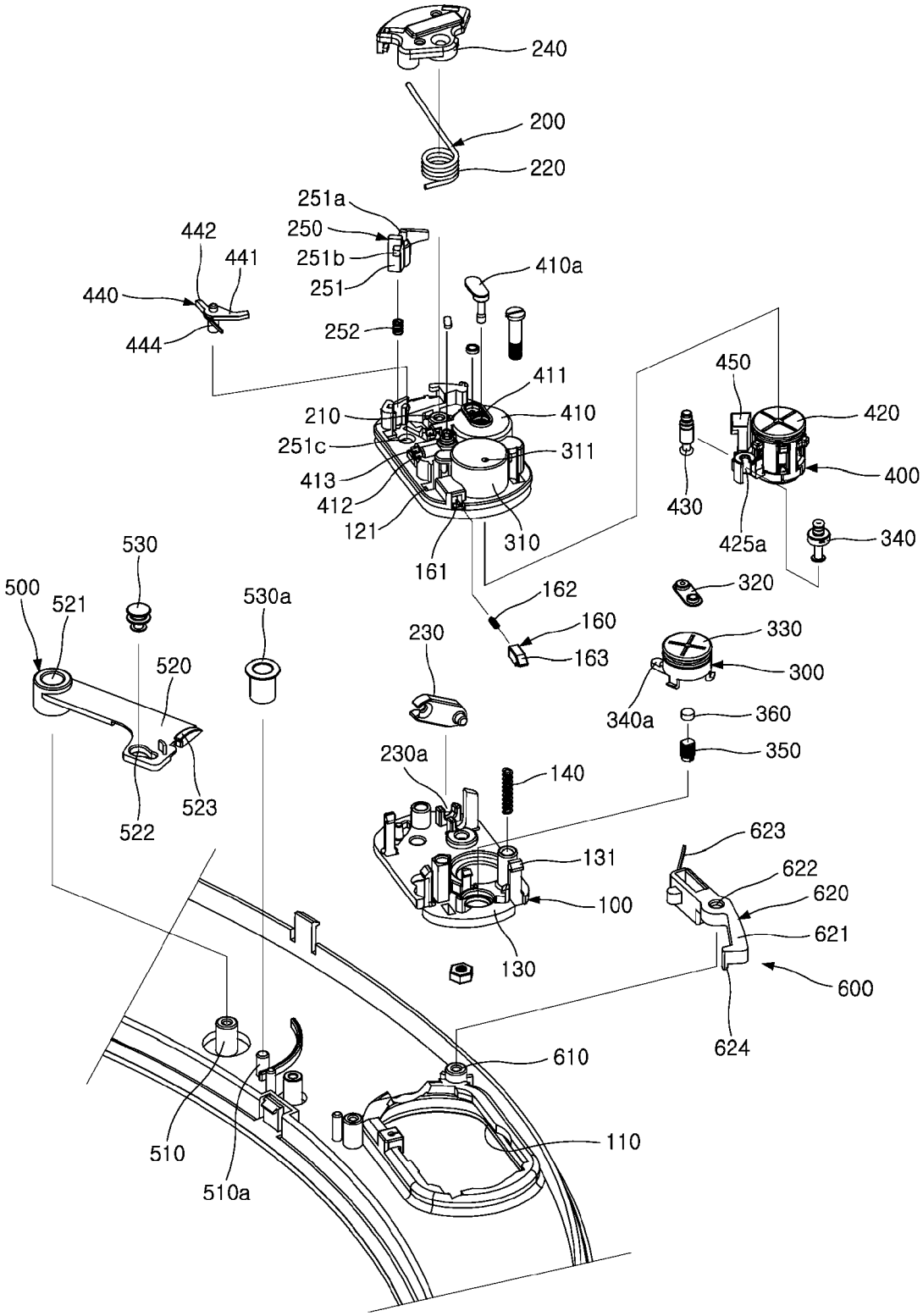
FIG. 2 is an exploded perspective view showing the present invention.
Figure 3:
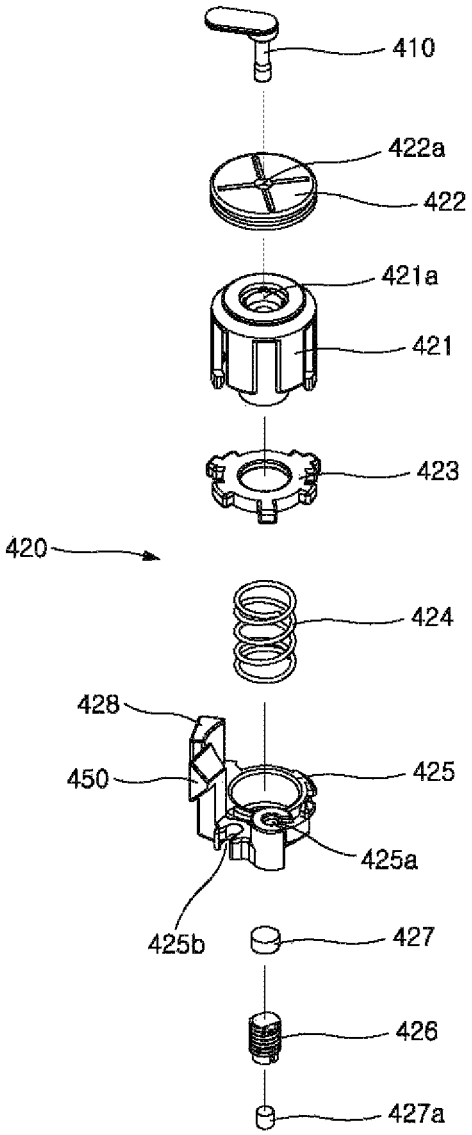
FIG. 3 is an exploded perspective view showing an air inlet regulator of the present invention.

The present invention is described hereafter in detail with reference to the accompanying drawings. FIG. 1 is a perspective view showing the present invention; FIG. 2 is an exploded perspective view showing the present invention; and FIG. 3 is an exploded perspective view showing an air inlet regulator of the present invention.

An unpowered and automatically flushing toilet seat, for a water tank, having detachable and waterproof functions, the toilet seat includes: a seating switch 100 configured to guide downward movement of a toilet seat 10 by a sitting user's body weight, and to guide upward movement of the toilet seat 10 when the user stands up from the toilet seat 10 and the user's body weight is unloaded; a loading unit 200 configured to press a loading member 220 in conjunction with the downward movement of the toilet seat 10 so as to obtain a loading force to pull a flushing wire 540 of an opening and closing member 500, and to pull the flushing wire 540 of the opening and closing member 500 in conjunction with the downward movement of the toilet seat 10 by the loading force of the restoring loading member 220 when the user's body weight is unloaded; the opening and closing member 500 configured to supply flushing water of a water tank to a toilet main body through a drain hole opened while a siphon cover 20 is rotated upward by the flushing wire 540 pulled by the loading force of the loading member 220 to remove excreta, and to allow the siphon cover 20 being rotated downward to close the drain hole when the loading force of the loading member 220 is released; and a flushing-maintaining unit 600 configured to maintain operation of the opening and closing member 500 until set water is discharged while preventing abrupt restoration of the restoring loading member 220.

Further, an unpowered and automatically flushing toilet seat, for a water tank, having detachable and waterproof functions, the toilet seat includes: a seating switch 100 configured to guide downward movement of a toilet seat 10 by a sitting user's body weight, and to guide upward movement of the toilet seat 10 when the user stands up from the toilet seat 10 and the user's body weight is unloaded; a loading unit 200 configured to press a loading member 220 in conjunction with the downward movement of the toilet seat 10 so as to obtain a loading force to pull a flushing wire 540 of an opening and closing member 500, and to pull the flushing wire 540 of the opening and closing member 500 in conjunction with the downward movement of the toilet seat 10 by the loading force of the restoring loading member 220 when the user's body weight is unloaded; a toilet paper time and flush control unit 400 configured to discharge air inside a guide rib 410 as an air inlet regulator 420 operating in conjunction with the downward movement of the toilet seat 10 is moved upward, and to adjust an amount of air flowing in the guide rib 410 as the air inlet regulator 420 operating in conjunction with the upward movement of the toilet seat 10 is moved downward when the user's body weight is unloaded, thereby controlling user's toilet paper-disposal time and flushing; the opening and closing member 500 configured to supply flushing water of a water tank to a toilet main body through a drain hole opened while a siphon cover 20 is rotated upward by the flushing wire 540 pulled by the loading force of the loading member 220 to remove excreta, and to allow the siphon cover 20 being rotated downward to close the drain hole when the loading force of the loading member 220 is released; and a flushing-maintaining unit 600 configured to maintain operation of the opening and closing member 500 until set water is discharged while preventing abrupt restoration of the restoring loading member 220.

Further, an unpowered and automatically flushing toilet seat, for a water tank, having detachable and waterproof functions, the toilet seat includes: a seating switch 100 configured to guide downward movement of a toilet seat 10 by a sitting user's body weight, and to guide upward movement of the toilet seat 10 when the user stands up from the toilet seat 10 and the user's body weight is unloaded; a loading unit 200 configured to press a loading member 220 in conjunction with the downward movement of the toilet seat 10 so as to obtain a loading force to pull a flushing wire 540 of an opening and closing member 500, and to pull the flushing wire 540 of the opening and closing member 500 in conjunction with the downward movement of the toilet seat 10 by the loading force of the restoring loading member 220 when the user's body weight is unloaded; a feces and urine distinguishing unit 300 configured to adjust a discharge amount of air inside a distinguishing-guide rib 310 as a guide rod 330 operating in conjunction with the downward movement of the toilet seat 10 is moved in the distinguishing-guide rib 310, such that when a feces and urine determination member 340*a* fails to press a feces and urine determination pin 340, user's excreta is determined as urine, and when the feces and urine determination member 340*a* presses the feces and urine determination pin 340, user's excreta is determined as feces; a toilet paper time and flush control unit 400 configured to discharge air inside a guide rib 410 as an air inlet regulator 420 operating in conjunction with the downward movement of the toilet seat 10 is moved upward, and to adjust an amount of air flowing in the guide rib 410 as the air inlet regulator 420 operating in conjunction with the upward movement of the toilet seat 10 is moved downward when the user's body weight is unloaded, thereby controlling user's toilet paper-disposal time and flushing; the opening and closing member 500 configured to supply flushing water of a water tank to a toilet main body through a drain hole opened while a siphon cover 20 is rotated upward by the flushing wire 540 pulled by the loading force of the loading member 220 to remove excreta, and to allow the siphon cover 20 being rotated downward to close the drain hole when the loading force of the loading member 220 is released; and a flushing-maintaining unit 600 configured to maintain operation of the opening and closing member 500 until set water is discharged while preventing abrupt restoration of the restoring loading member 220.

The seating switch 100 includes: the cover 120 mounted to a mounting hole 110 formed in the toilet seat 10, and configured such that a hook 131 protruding from the sensing plate 130 is coupled to a hook hole 121 formed therethrough; the sensing plate 130 mounted to the toilet main body as the hook 131 is coupled to the hook hole 121 formed through the cover 120; and a seat spring 140 mounted between the cover 120 and the sensing plate 130.

The toilet seat further includes a waterproof sheet 150 with the sensing plate 130 and the cover 120 surrounded thereby mounted to the mounting hole 110.

The toilet seat further includes a mounting fixing unit 160 configured to fix the cover 120 to the mounting hole 110, and the mounting fixing unit 160 includes: a mounting fixing hole 161 grooved at a side of the cover 120; a mounting spring 162 accommodated in the mounting fixing hole 161, and configured to press a mounting fixing member 163; and the mounting fixing member 163 mounted to the mounting fixing hole 161 and the toilet seat 10 by pressure of the mounting spring 162, and configured to prevent separation of the cover 120.

It is preferred that a loading unit 200, or the loading unit 200 and the toilet paper time and flush control unit 400, or the loading unit 200, the feces and urine distinguishing unit 300 and the toilet paper time and flush control unit 400 are mounted between the cover 120 and the sensing plate 130 and modularized.

The loading unit 200 includes: a loading shaft 210 protruding from a sensing plate 130 of the seating switch 100; the loading member 220 mounted to the loading shaft 210, and configured to generate the loading force to pull the flushing wire 540 by being stopped by a guide protrusion 523 of a wire guide 520 while being rotated by being pressed by a loading lever 230 operating in conjunction with the downward movement of the toilet seat 10; the loading lever 230 configured such that a second end thereof accommodates a side of the loading member 220 to press and rotate the loading member 220 and a first end thereof is rotatably mounted to a guide groove 230*a* provided on the sensing plate 130; and a lever guide 240 mounted to a cover 120 to press the loading lever 230 while preventing the loading lever 230 from being separated from the guide groove 230*a*.

The toilet seat further includes a loading-maintaining member 250 accommodating the loading member 220 rotated by pressure of the loading lever 230 to generate a loading force, and maintaining the loading force of the loading member 220 until the loading member 220 is separated therefrom, and the loading-maintaining member 250 includes: a loading-maintaining body 251 provided with an inclined stop protrusion 251*a* protruding therefrom such that the loading member 220 is moved and stopped thereby; and a control spring 252 configured to support the loading-maintaining body 251.

The opening and closing member 500 includes: a rotation guide shaft 510 protruding from the toilet seat 10; the wire guide 520 configured to be rotated to pull the flushing wire 540 by the loading force of the loading member 220 stopped by the guide protrusion 523 of the wire guide 520 as the rotation guide shaft 510 is mounted to a shaft hole 521; a wire roller 530 rotatably mounted to a roller guide hole 522 formed in the wire guide 520 to guide the flushing wire 540; and the flushing wire 540 configured to connect the siphon cover 20 and the toilet seat 10 via the wire roller 530.

The toilet seat further includes an auxiliary wire roller 530*a* mounted to a rotation guide shaft 510*a* protruding from the toilet seat 10 to guide rotation of the wire guide 520.

The flushing-maintaining unit 600 includes: a rotation guide shaft 610 protruding from the toilet seat 10; and a retaining member 620 mounted to the rotation guide shaft 610, and configured to delay a restoration time by absorbing the restoring force of the restoring loading member 220.

The retaining member 620 includes: a retaining body 621 configured such that the rotation guide shaft 610 is mounted to a shaft hole 622; and an elastic piece 623 protruding from an end portion of the retaining body 621, and absorbing the restoring force of the loading member 220 and supporting the same by being brought into close contact with an inner surface of the toilet seat 10.

The toilet paper time and flush control unit 400 includes: a guide rib 410 configured to protrude from the cover 120 of the seating switch 100 such that an inlet check valve 410*a* opens and closes a discharge through-hole 11 formed therethrough, and formed with an excreta discharge holes 412 and 413 at a side thereof with which feces/urine adjusting bolts 412' and 413' are engaged; an air inlet regulator 420 accommodated in the guide rib 410, and configured such that air in the guide rib 410 is discharged by the inlet check valve 410*a* opened in conjunction with the downward movement of the toilet seat 10, and the amount of air flowing in the guide rib 410 is regulated by closing the inlet check valve 410*a* in conjunction with the upward movement of the toilet seat 10; a toilet paper time-check pin 430 mounted to a check pin-control groove 425*b* formed in the air inlet regulator 420, and configured to open and close a guide rib through-hole 411' formed through the guide rib 410 while being vertically moved along the air inlet regulator 420 to secure a time for the user to discard toilet paper; and an unloading guide member 440 configured to release a supporting force of the loading-maintaining member 250 of the loading unit 200 as the air inlet regulator 420 is vertically moved in the guide rib 410 to press an unloading member 450 provided in the air inlet regulator 420.

The air inlet regulator 420 includes: an air inlet regulating member 421 configured to be vertically moved in the guide rib 410; a seat cover 422 seated on an upper surface of the air inlet regulating member 421; through-holes 422*a* and 421*a* formed through the seat cover 422 and the air inlet regulating member 421 to be coupled with the inlet check valve 410*a*; a flush washer 423 mounted to the air inlet regulating member 421 and configured to support an adjusting spring 424; the adjusting spring 424 mounted to the air inlet regulating member 421 to be brought into close contact with the flush washer 423; an anti-separation member 425 mounted to a lower end portion of the air inlet regulating member 421 to prevent separation of the adjusting spring 424, configured to compress the adjusting spring 424 in conjunction with the downward movement of the toilet seat 10, and provided with a determining pin-control groove 425*a* and the check pin-control groove 425*b* on an outer circumferential surface thereof; and an inflow-adjusting bolt 426 fastened to the through-hole 421*a* of the air inlet regulating member 421 to guide air flow.

The toilet seat further includes: an adjustment filter 427 configured to guide the air flow by being pressed by a fastening force of the inflow-adjusting bolt 426 fastened to the through-hole 421*a* of the air inlet regulating member 421; and a fine adjustment filter 427*a* accommodated in the inflow-adjusting bolt 426, and configured to filter foreign substances.

The unloading guide member 440 includes: an unloading guide body 441 rotatably mounted to a coupling hole 440*a* formed in the cover 120; an unloading control protrusion 442 protruding from a first side of the unloading guide body 441 to be selectively stopped by a loading-maintaining control protrusion 251*b* of the loading-maintaining member 250; an unloading guide protrusion 443 protruding from a second side of the unloading guide body 441 at an obtuse angle with respect to the unloading control protrusion 442 to press the unloading member 450; and a restoring elastic piece 444 protruding from the first side of the unloading guide body 441 to be brought into close contact with an inner surface of the toilet seat 10, thereby restoring the unloading guide body 441 with pressure of the unloading member 450 released.

The feces and urine distinguishing unit 300 includes: a distinguishing-guide rib 310 protruding from a cover 120 of the seating switch 100, with an inlet through-hole 311 formed therethrough; a discharge check valve 320 configured to open and close the inlet through-hole 311 of the distinguishing-guide rib 310; a guide rod 330 accommodated in the distinguishing-guide rib 310, and configured to discharge air in the distinguishing-guide rib 310 to a guide through-hole 330*a* while being moved by pressure of a guide spring 330' in conjunction with the downward movement of the toilet seat 10; a feces and urine determination pin 340 mounted to a determining pin-control groove 425*a* of the air inlet regulator 420, and configured to determine whether excreta is feces or urine in accordance with opening and closing of a urine discharge hole 413 by pressure of the feces and urine determination member 340*a* protruding from a side of the guide rod 330; and a discharge adjusting bolt 350 fastened to the guide through-hole 330*a* to control air flow discharged through the guide through-hole 330*a*.

The toilet seat further includes an adjustment filter 360 configured to guide the air flow by being pressed by a fastening force of the discharge adjusting bolt 350 fastened to the guide through-hole 330*a* of the guide rod 330.

Hereinafter, the operation of the present invention will be described.

First, the present invention can be operated only with the loading unit 200, the opening and closing member 500, and the flushing-maintaining unit 600, or can be operated only with the loading unit 200, the toilet paper time and flush control unit 400, the opening and closing member 500, and the flushing-maintaining unit 600, but the operation of the present invention is described hereafter in limitation to the configuration including the loading unit 200, the feces and urine distinguishing unit 300, the toilet paper time and flush control unit 400, the opening and closing member 500, and the flushing-maintaining unit 600.

Figure 4:
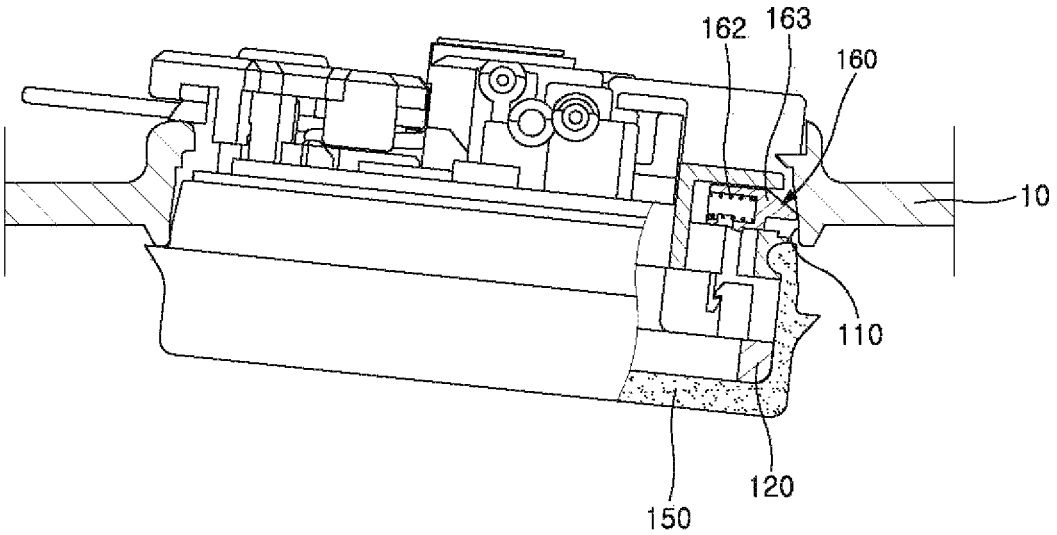
FIGS. 4 and 5 are process views showing installation of a seating switch of the present invention in a mounting hole.
Figure 5:
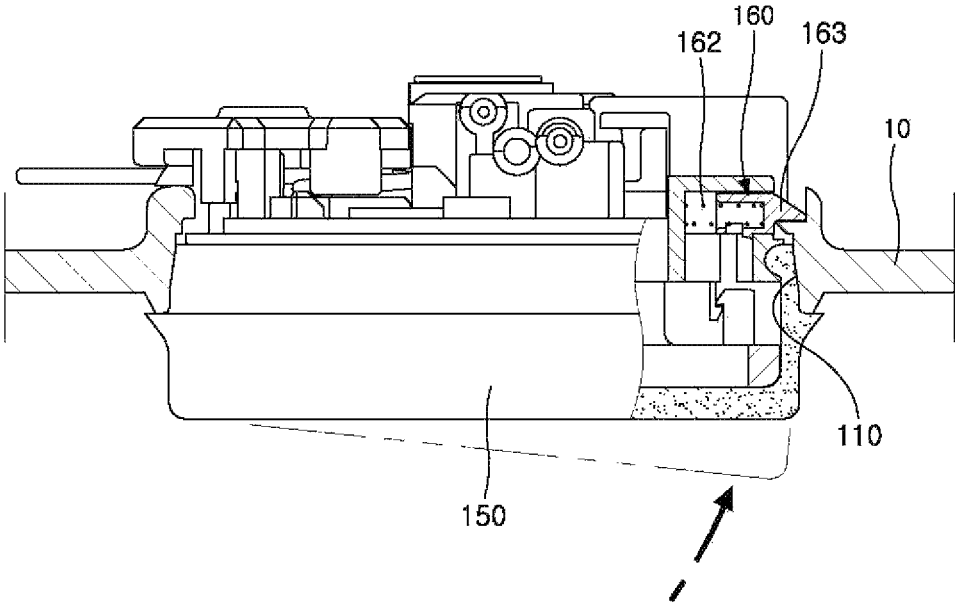

The loading unit 200, the feces and urine distinguishing unit 300, and the toilet paper time and flush control unit 400 are mounted between the cover 120 and sensing plate 130 of the seating switch 100 to form a single module, and after the same is surrounded by the waterproof sheet 150 to form the seating switch 100, the seating switch 100 is mounted to the mounting hole 110 of the toilet seat 10, wherein as shown in FIGS. 4 to 5, in the state where the first side of the seating switch 100 is mounted to a side of the mounting hole 110, the second side of the seating switch is rotated upward.

Here, the mounting fixing member 163 of the mounting fixing unit 160 is brought in close contact with the inner surface of the mounting hole 110 to be moved in the mounting fixing hole 161 while compressing the mounting spring 162, and when the mounting fixing member 163 being moved in the mounting fixing hole 161 passes through the mounting hole 110, the mounting fixing member protrudes by the restoring force of the mounting spring 162 to be fixed to the toilet seat 10.

The loading unit 200, the feces and urine distinguishing unit 300, and the toilet paper time and flush control unit 400 are mounted between the cover 120 and sensing plate 130 of the seating switch 100 to form a single module, and are surrounded by the waterproof sheet 150 and mounted to the mounting hole 110, whereby the work process is simplified, the work efficiency is improved, and thus the work time can be shortened, and the waterproof function can be ensured.

Figure 6:
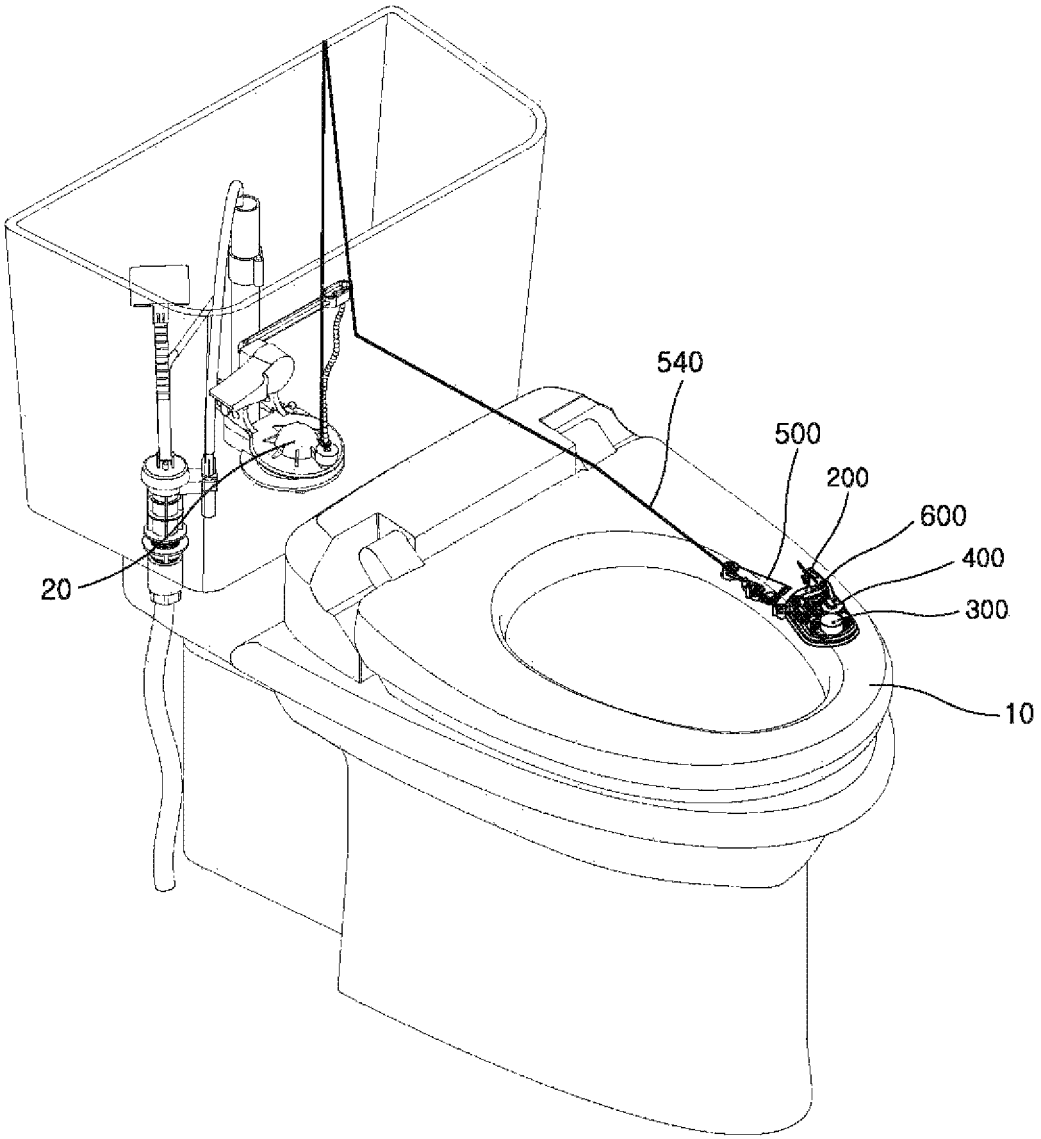
FIG. 6 is a view showing an installed state of the present invention.
Figure 7:
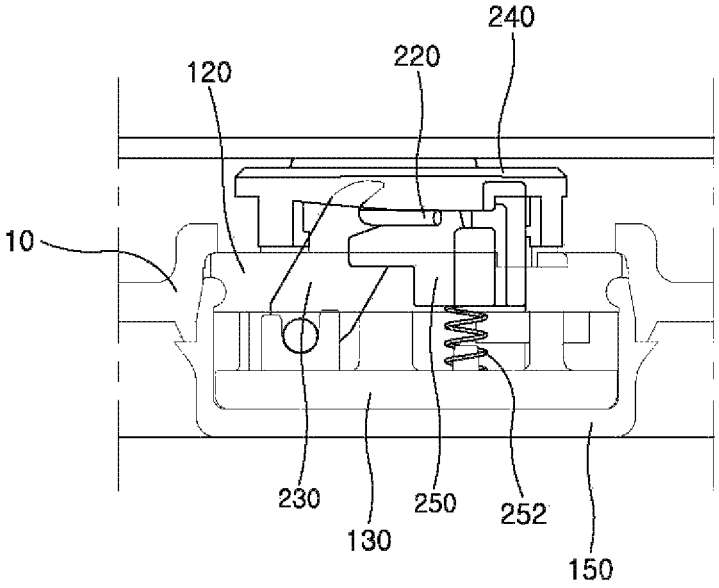
FIGS. 7 to 12 are views showing operation with a user sitting on a toilet seat with the present invention applied thereto.
Figure 8:
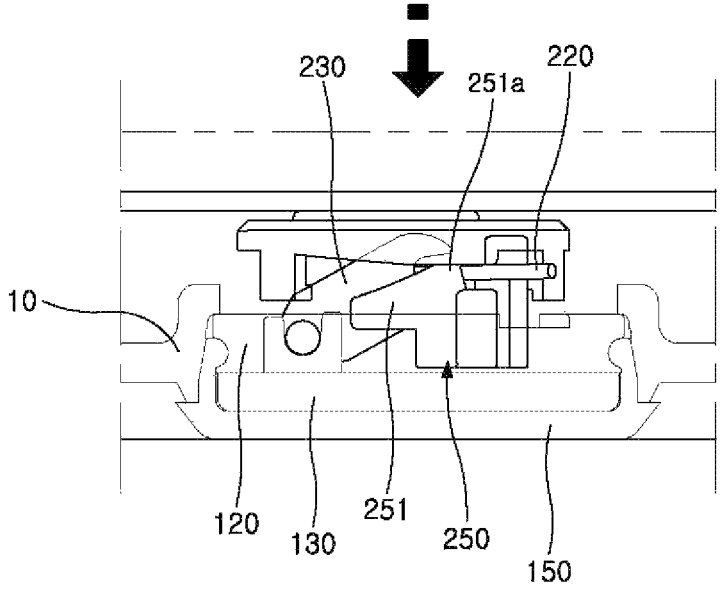
Figure 9:
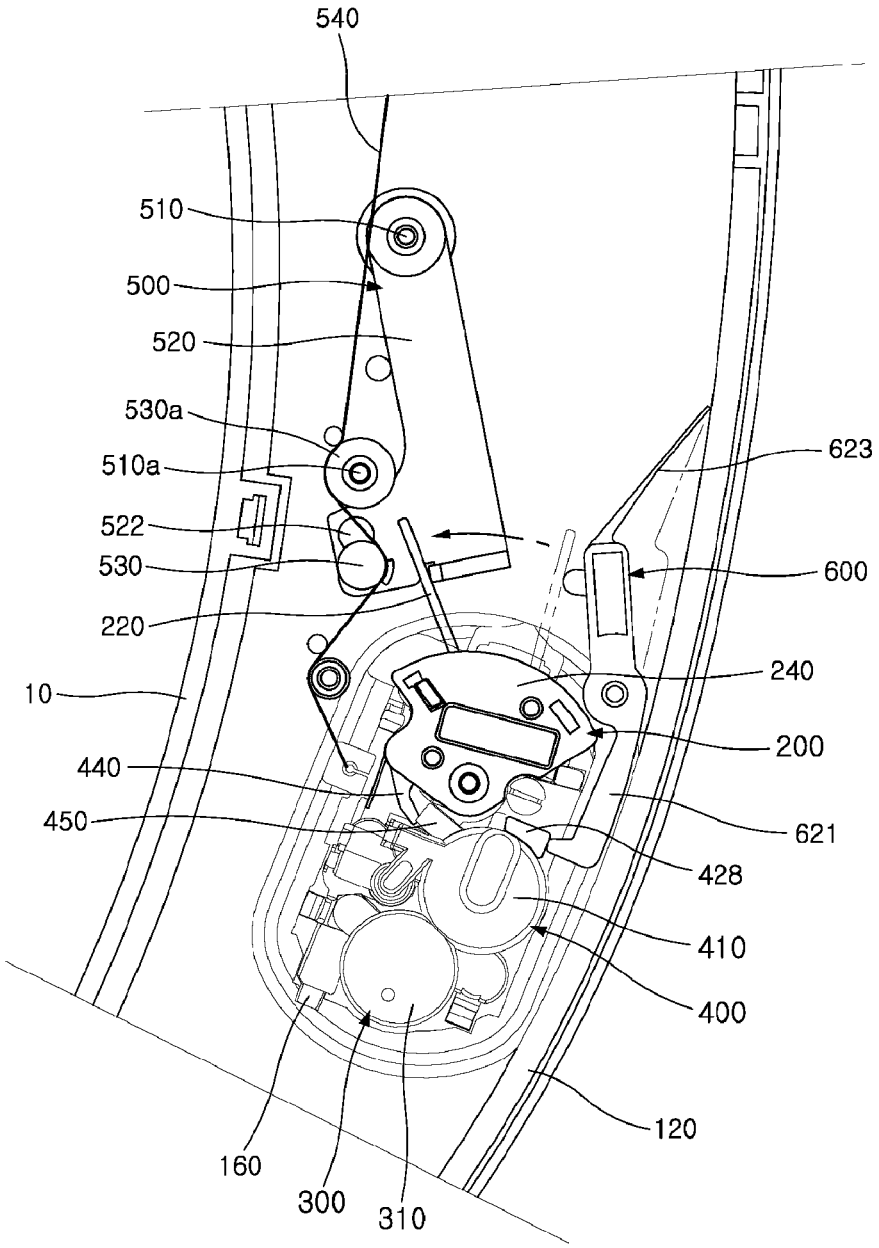
Figure 10:
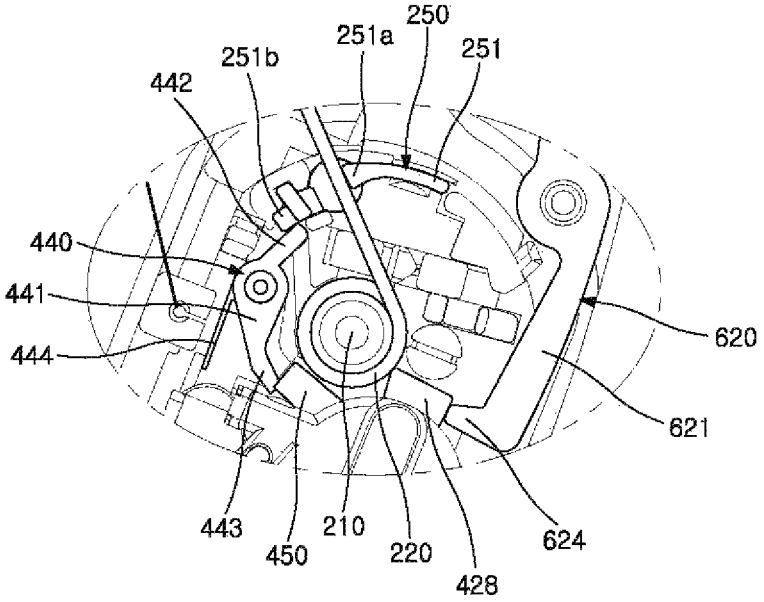

The toilet seat 10 with the seating switch 100 mounted thereto is seated on the toilet main body, and the toilet seat 10 and the siphon cover 20 are connected with the flushing wire 540 of the opening and closing member 500, whereby the installation of the present invention is completed as shown in FIG. 6.

When the user sits on the toilet seat 10 seated on the toilet main body configured above described, as shown in FIGS. 7 to 10, by the user's body weight, the toilet seat 10 is moved downward such that the cover 120 of the seating switch 100 seated on the toilet main body compresses the seat spring 140 disposed between the cover 120 and the sensing plate 130.

Further, as the toilet seat 10 is moved downward, the lever guide 240 of the loading unit 200 presses the second end of the loading lever 230 with the first end thereof mounted to the guide groove 230*a*, and at the same time, the loading lever 230 is rotated at a predetermined angle around the guide groove 230*a* and presses the second side of the loading member 220 coupled to the loading shaft 210 to move the same, thereby being stopped by the stop protrusion 251*a* of the loading-maintaining member 250 and the guide protrusion 523 of the wire guide 520 to maintain the loading force of the loading member 220.

Here, since the first side of the loading member 220 is brought in close contact with the guide rib 410, the second side of the loading member 220 is rotated inwardly to press the stop protrusion 251*a* of the loading-maintaining member 250 and the guide protrusion 523 of the wire guide 520, and since the stop protrusion 251*a* and the guide protrusion 523 are formed to be inclined, after the loading-maintaining body 251 is moved downward by a predetermined distance by the compressive force of the loading member 220 while compressing the control spring 252, when the loading member 220 passes through the stop protrusion 251*a*, the loading-maintaining member 250 is restored by the restoring force of the control spring 252, and the state where the loading member 220 is stopped by the stop protrusion 251*a* and the guide protrusion 523 of the wire guide 520 is maintained, whereby the loading force of the loading member 220 is maintained.

Further, as the toilet seat 10 is moved downward, the toilet paper time and flush control unit 400 is moved upward and simultaneously, the unloading guide member 440 with the pressure of the unloading member 450 released is operated in such a manner that by the restoring force of the restoring elastic piece 444 brought in close contact with the inner surface of the toilet seat 10, the unloading guide body 441 is rotated outwardly around the coupling hole 440*a*, the unloading control protrusion 442 protruding from the unloading guide body 441 is disposed at the lower portion of the loading-maintaining control protrusion 251*b* of the loading-maintaining body 251, and the unloading member 450 presses the unloading guide member 440, whereby until the unloading control protrusion 442 is separated from the lower portion of the loading-maintaining control protrusion 251*b*, the loading force of the loading member 220 is maintained to prevent the loading member 220 from being restored even though the toilet seat 10 is moved upward.

Herein, to facilitate the movement of the loading lever 230, the lower surface of the lever guide 240 may be formed with a curved surface (not shown), and the retaining member 620 of the flushing-maintaining unit 600 with the pressure of the loading member 220 released is rotated around the shaft hole 622 with the rotation guide shaft 610 mounted thereto by the elasticity of the elastic piece 623, such that the release guide protrusion 624 protruding from the second side of the retaining body 621 is separated from the guide protrusion 428 of the air inlet regulator 420.

Figure 11:
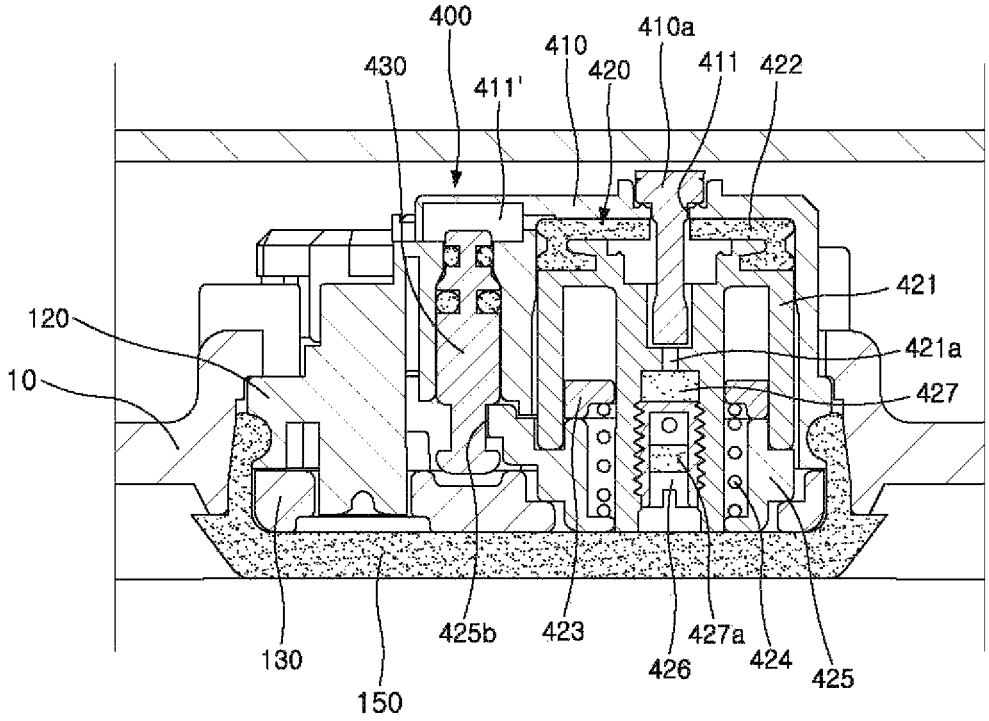
Figure 12:
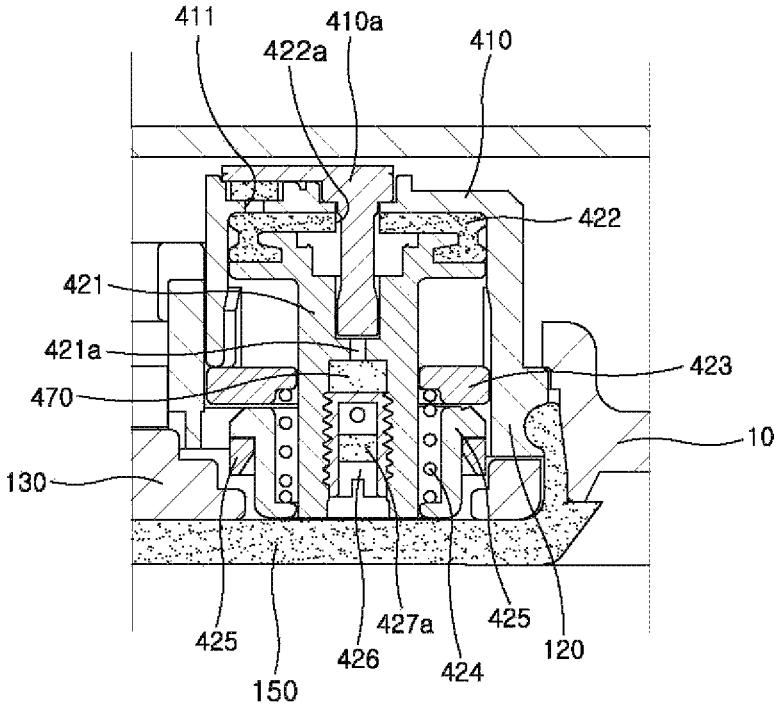
Figure 13:
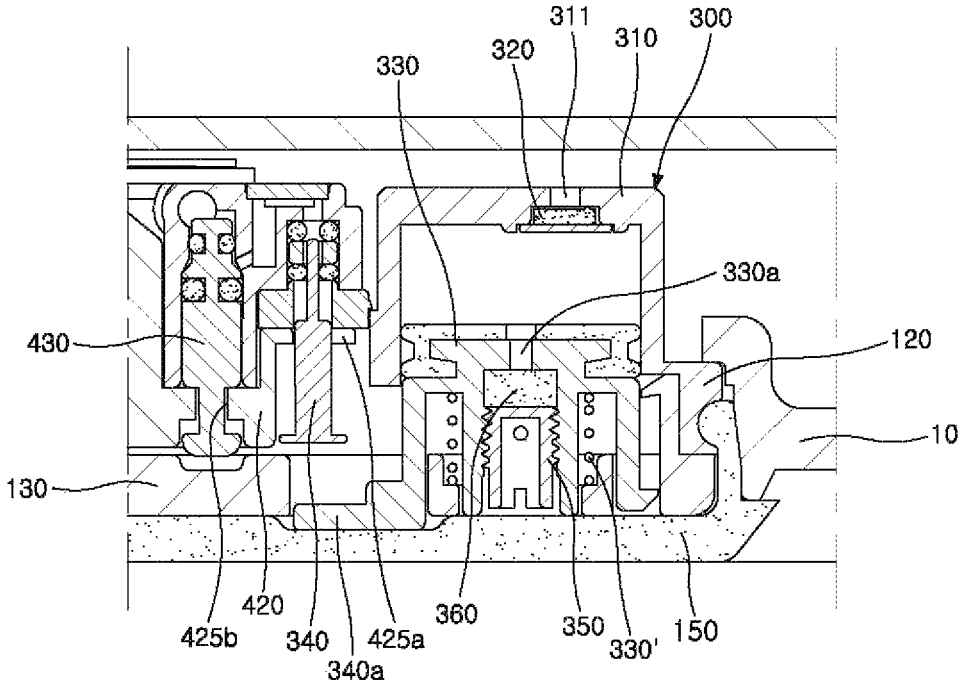
FIGS. 13 to 17 are views showing operation with a feces and urine distinguishing unit of the present invention determining a user's feces and urine.
Figure 14:
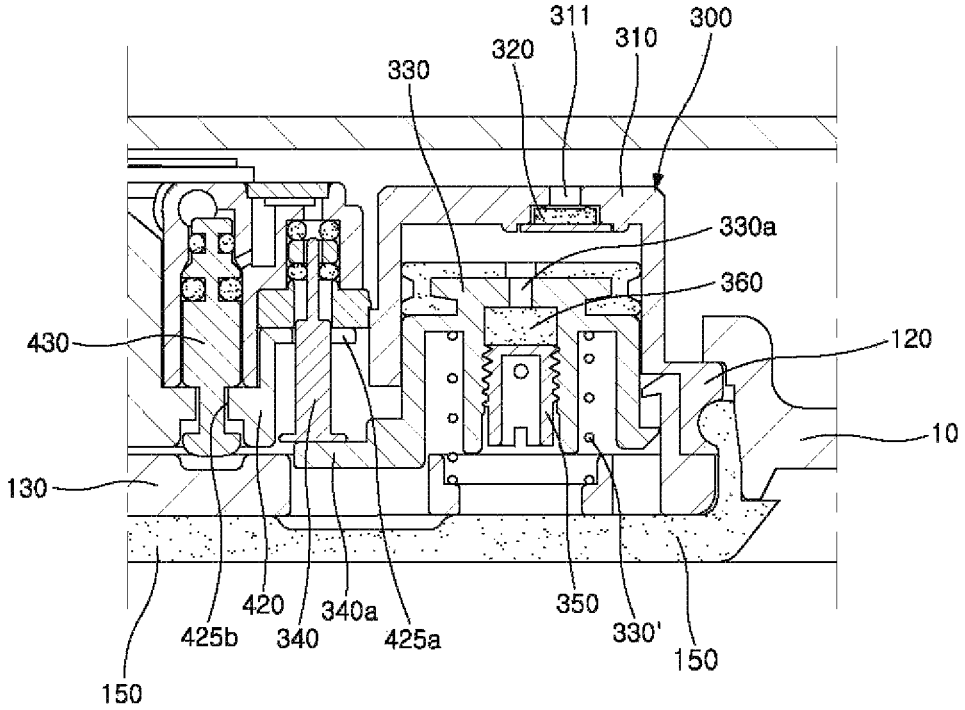
Figure 15:
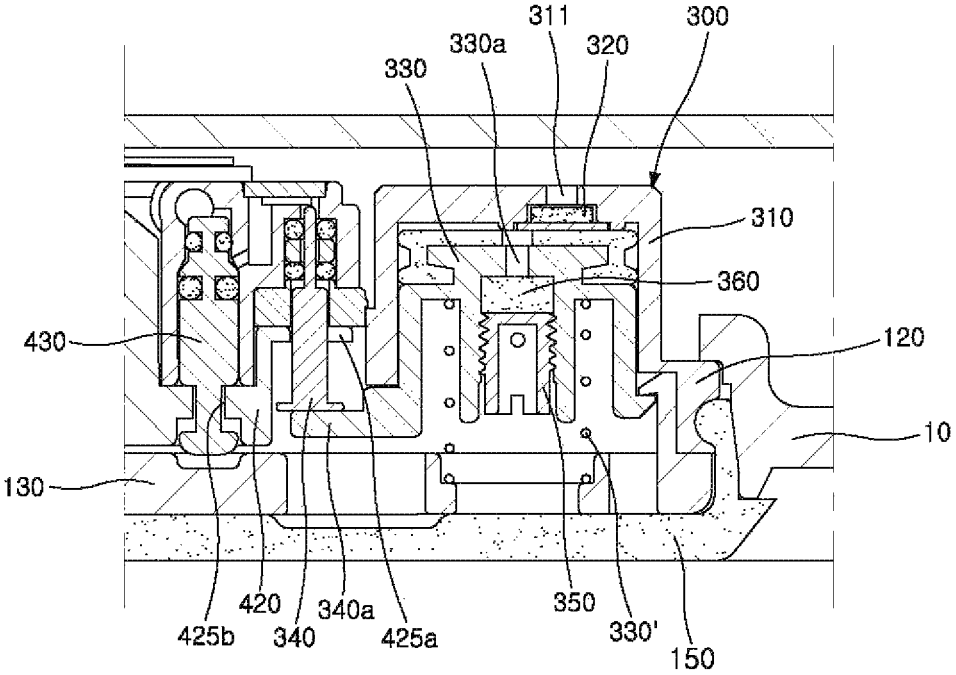
Figure 16:
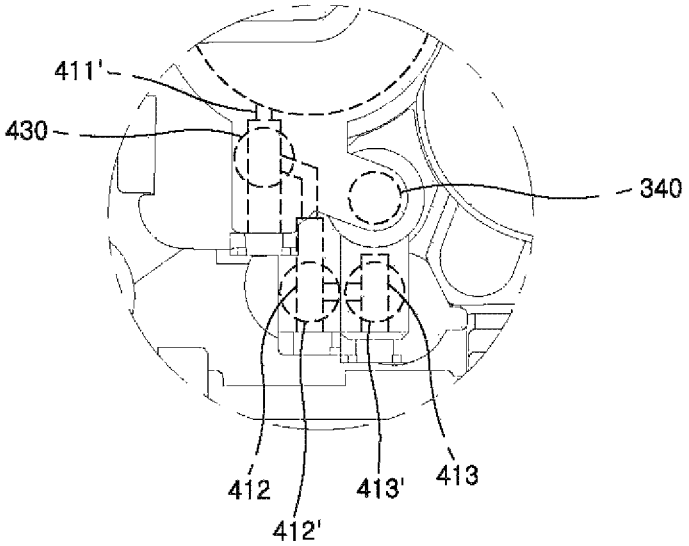
Figure 17:
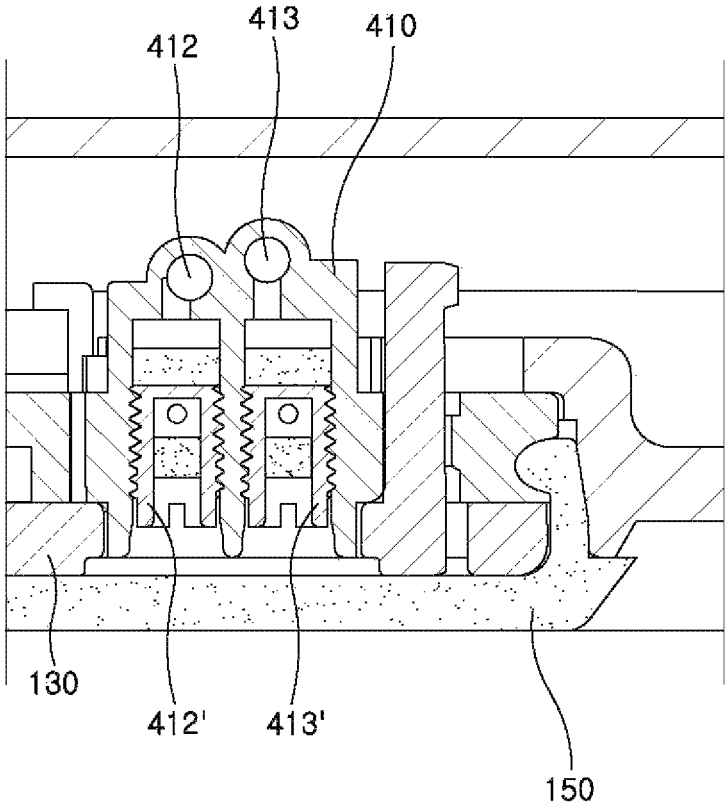

Further, as shown in FIGS. 11 to 12, the air inlet regulator 420 of the toilet paper time and flush control unit 400 is moved to the inner upper portion of the guide rib 410 in conjunction with the downward movement of the toilet seat 10, and simultaneously, the air in the guide rib 410 is discharged outside the guide rib 410 through the inlet check valve 410*a* via the discharge through-hole 11, and as the air inlet regulator 420 is moved upward, the toilet paper time-check pin 430 mounted to the check pin-control groove 425*b* is moved upward to close the guide rib through-hole 411' formed through the guide rib 410.

Herein, when the user's body weight is applied to the toilet seat 10, the inlet check valve 410*a* is opened to discharge the air in the guide rib 410 to the outside, and when the user's body weight is released, the inlet check valve is closed to block the inflow of air to the guide rib 410.

When the air inlet regulator 420 is moved to the inner upper portion of the guide rib 410, the anti-separation member 425 compresses the adjusting spring 424 brought in close contact with the flush washer 423, wherein since the flush washer 423 is maintained to be stopped by the guide rib 410, it is possible to maintain the compressive force of the adjusting spring 424 in response to the movement of the anti-separation member 425.

Further, as shown in FIGS. 13 to 17, by the pressure of the guide spring 330' compressed in conjunction with the downward movement of the toilet seat 10, the guide rod 330 of the feces and urine distinguishing unit 300 is moved to the inner upper portion of the distinguishing-guide rib 310, and here, the air in the distinguishing-guide rib 310 fails to be discharged through the inlet through-hole 311 closed by the discharge check valve 320 and is discharged through the discharge adjusting bolt 350 via the guide through-hole 330*a* of the guide rod 330.

Here, the discharge adjusting bolt 350 is fastened to the guide through-hole 330*a* of the guide rod 330 and compresses the adjustment filter 360, and also can adjust the amount of air flow passing through the adjustment filter 360 according to the compressive force of the adjustment filter 360.

Further, as the air in the distinguishing-guide rib 310 is discharged through the discharge adjusting bolt 350, when the feces and urine determination member 340*a* protruding from the side of the guide rod 330 moved to the inner upper portion of the distinguishing-guide rib 310 presses the feces and urine determination pin 340 mounted to the determining pin-control groove 425*a* of the air inlet regulator 420 to close the urine discharge hole 413, user's excreta is determined as feces, and the feces and urine determination pin 340 closes the urine discharge hole 413 to such air only through the feces discharge hole 412, and when the feces and urine determination member 340*a* fails to press the feces and urine determination pin 340 not to close the urine discharge hole 413, the guide rod 330 moves faster than the time of the feces determination because the air is sucked into the feces discharge hole 412 and the urine discharge hole 413 which are always open.

Herein, when the user's body weight is applied to the toilet seat 10, the discharge check valve 320 is closed to block the inflow of air to the distinguishing-guide rib 310, and when the user's body weight is released, the discharge check valve is opened to discharge the air in the distinguishing-guide rib 310 to the outside.

After the user sitting on the toilet seat 10 uses the toilet, when the user stands up from the toilet seat 10, the toilet seat 10 is moved upward by the restoring force of the seat spring 140 of the seating switch 100.

Figure 18:
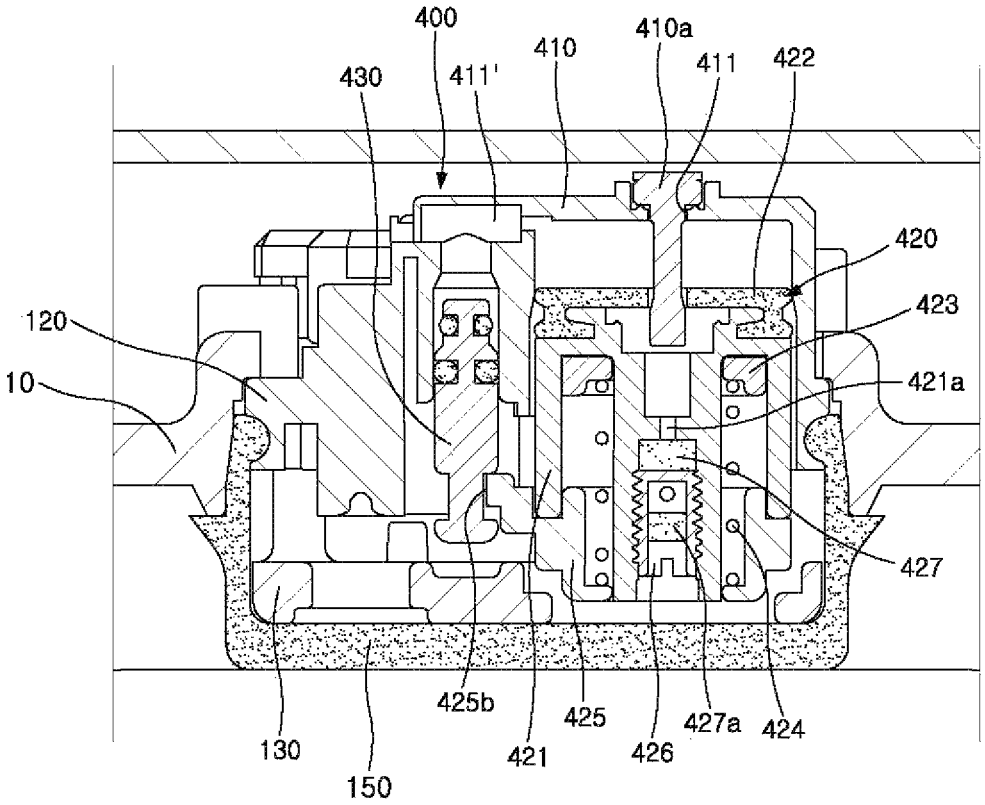
FIGS. 18 to 24 are views showing operation of flushing excreta when a user stands up from the toilet seat with the present invention applied thereto.
Figure 19:
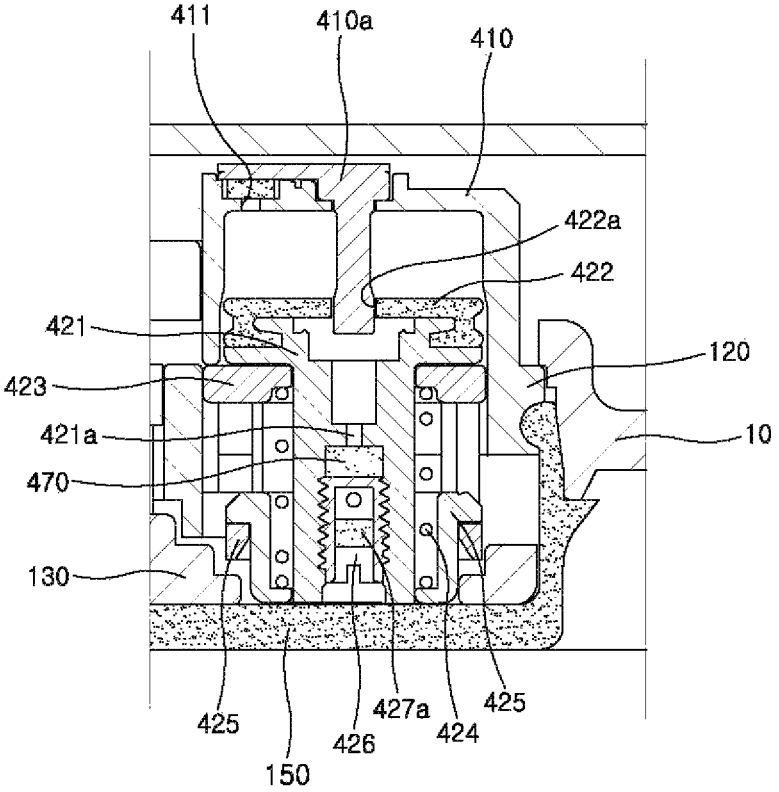
Figure 20:
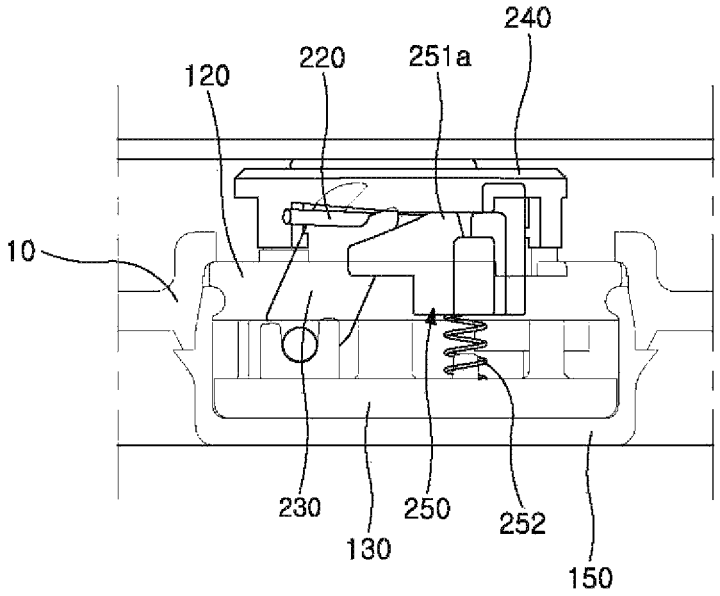

Here, as shown in FIGS. 18 to 20, the air inlet regulating member 421 of the air inlet regulator 420 of the toilet paper time and flush control unit 400 is operated in such a manner that the air inlet regulator 420 is moved to the inner lower portion of the guide rib 410 by the restoring force of the adjusting spring 424, and since the inlet check valve 410*a* closes the discharge through-hole 11 of the guide rib 410, air is supplied to the inner lower portion of the guide rib 410 only through the inflow-adjusting bolt 426 of the air inlet regulator 420.

Herein, the air flowing in the inflow-adjusting bolt 426 adjusts the amount of air flow passing through the adjustment filter 427 according to the compressive force of the inflow-adjusting bolt 426, whereby it is possible to secure a time to discard toilet paper by the toilet paper time and flush control unit 400 and is possible to delay the operating time of the opening and closing member 500.

Further, since foreign substances contained in the air are filtered through the fine adjustment filter 427*a* mounted inside the inflow-adjusting bolt 426, it is possible to use the adjustment filter 427 stably while preventing clogging of the same.

Figure 21:
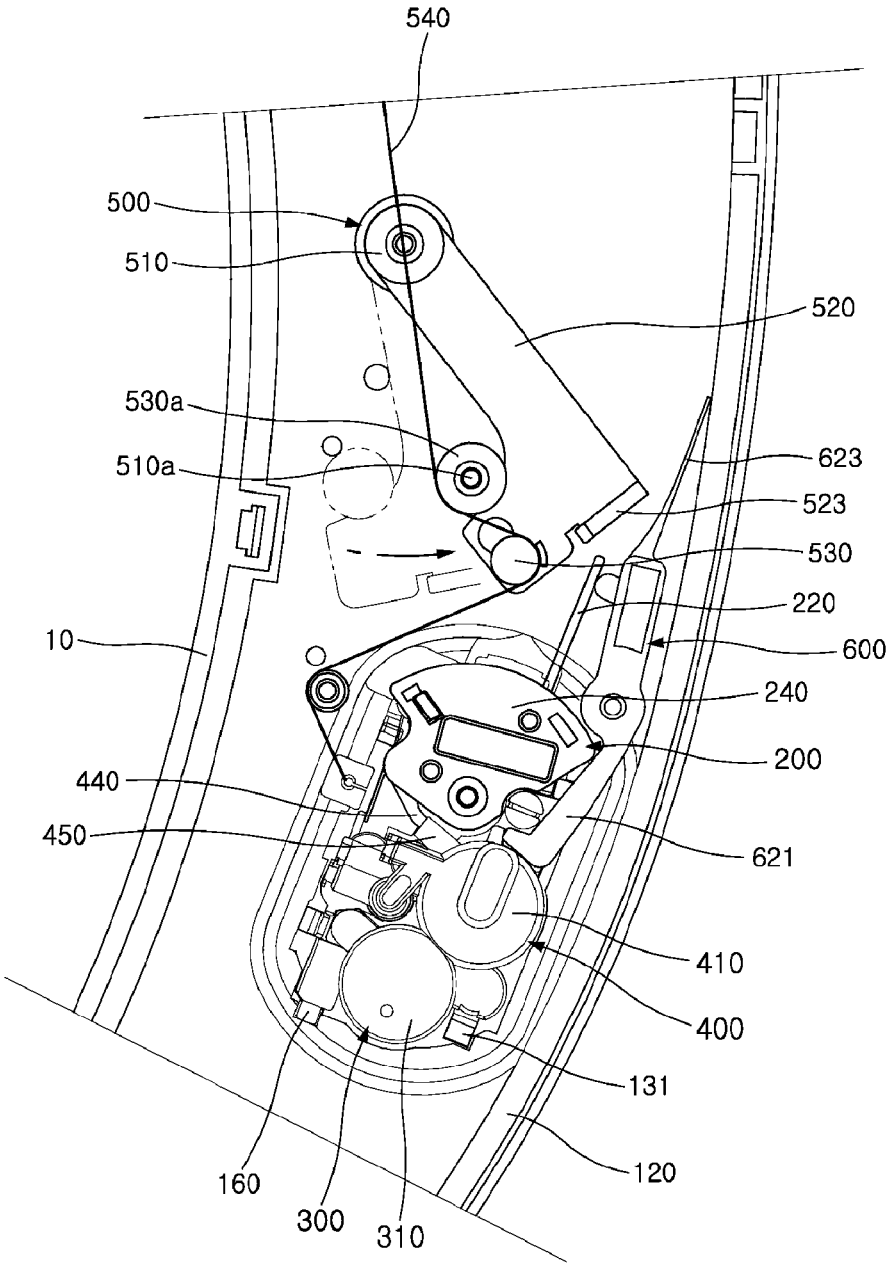

Further, as shown in FIG. 21, when the air inlet regulator 420 is moved to the lower portion of the guide rib 410 by a predetermined distance as air flows in the guide rib 410 through the inflow-adjusting bolt 426, the unloading member 450 formed a side of the anti-separation member 425 presses the unloading guide protrusion 443 of the unloading guide member 440, and then the unloading guide member 440 is rotated inwardly around the coupling hole 440*a* to compress the restoring elastic piece 444 brought in close contact with the inner surface of the toilet seat 10, thereby generating the restoring force, and simultaneously, the unloading control protrusion 442 formed on a side of the unloading guide body 441 is separated from the loading-maintaining control protrusion 251*b* of the loading-maintaining member 250.

Figure 22:
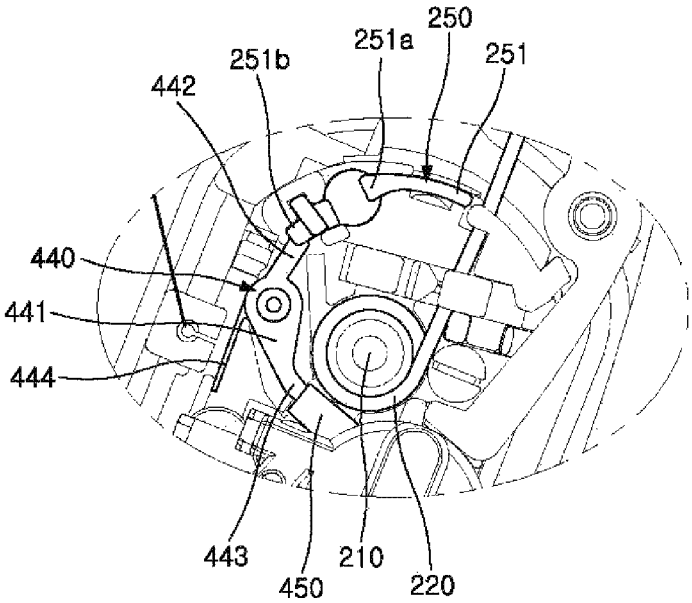
Figure 23:
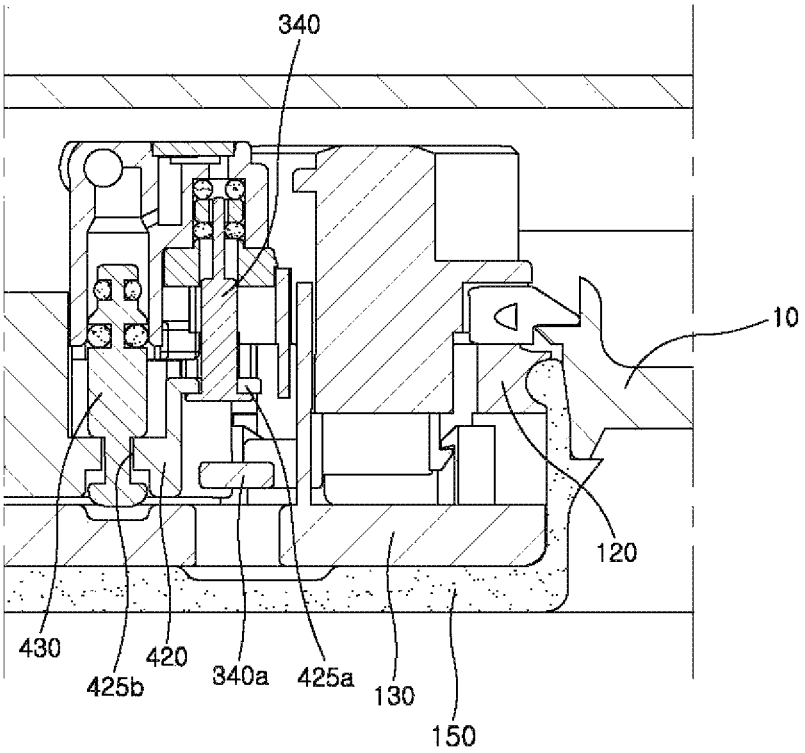
Figure 24:
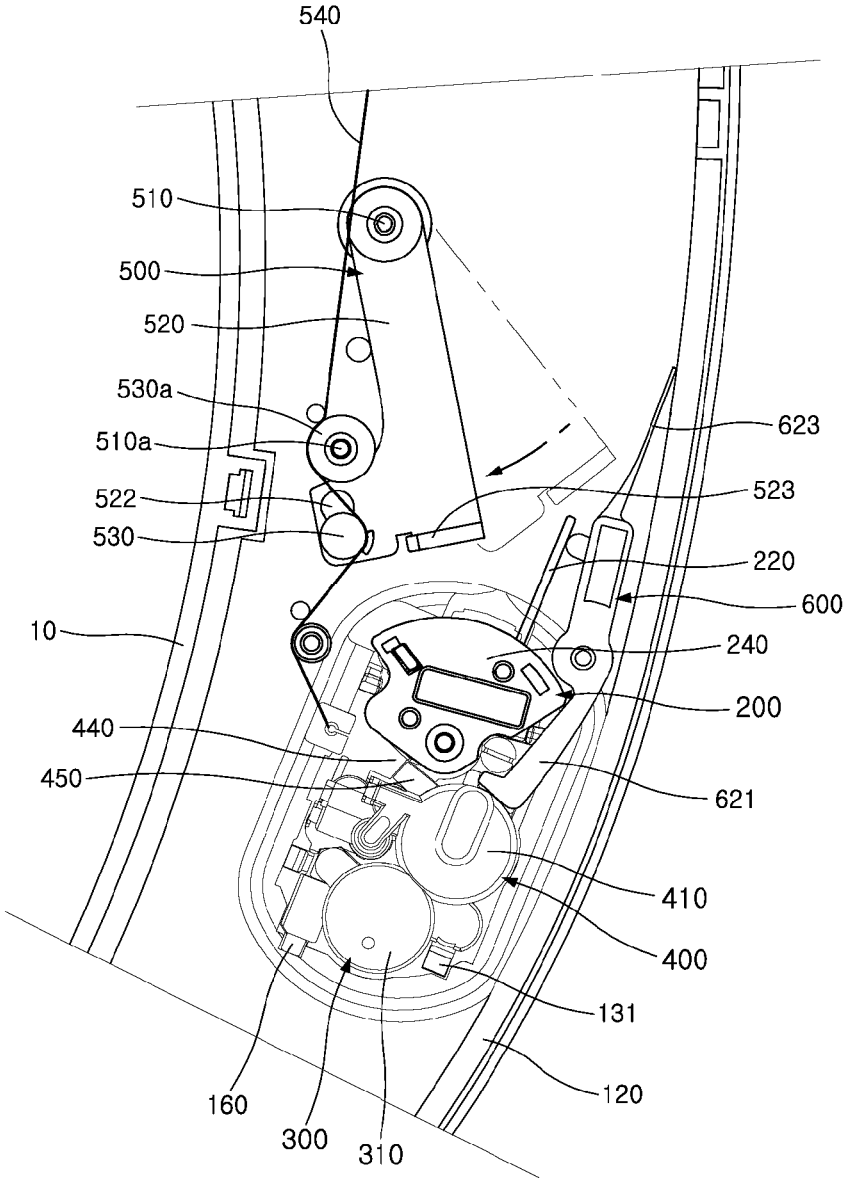

Further, the loading-maintaining member 250 with the stopping force released by the rotation of the unloading member 440 by the pressure of the unloading member 450 compresses the control spring 252 by the pressure of the lever guide 240 moved downward, and when the loading-maintaining body 251 is moved downward, the control force of the loading member 220 is lost, whereby as shown in FIGS. 22 to 24, the loading member 220 is restored by the compressed loading force, and simultaneously the wire guide 520 is rotated outwardly around the rotation guide shaft 510 since the loading member 220 is stopped by the guide protrusion 523, and the wire roller 530 mounted to the roller guide hole 522 pulls the flushing wire 540 connecting the inside of the toilet seat 10 and the siphon cover 20 to open the drain hole of the water tank by the upward rotation of the siphon cover 20, and the flushing water of the water tank is discharged to the toilet main body through the opened drain hole, thereby removing the excreta.

Herein, while the retaining member 620 of the flushing-maintaining unit 600 supports the restoring loading member 220, the loading member 220 delays the separation of the wire guide 520 from the guide protrusion 523, whereby the siphon cover 20 is closed by the flushing wire 540, and it is possible to prevent the phenomenon of not removing the excreta.

The retaining member 620 pressed by the loading member 220 is rotated around the rotation guide shaft 610 and the elastic piece 623 protruding from the retaining body 621 is brought in close contact with the inner surface of the toilet seat 10, whereby by absorbing the pressure of the loading member 220, it is possible to prevent abrupt restoration of the restoring loading member 220.

The flushing water discharged to the toilet main body is discharged to correspond the feces/urine determined by the feces and urine distinguishing unit 300, wherein as the air inlet regulator 420 is moved downward due to the separation of the user, when the toilet paper time-check pin 430 opens the guide rib through-hole 411' formed through the guide rib 410, the flushing water is supplied inside the guide rib 410 through the opened guide rib through-hole 411' via the urine discharge hole 413 or the urine discharge hole 413 and the feces discharge hole 412.

Here, the air supplied to the excreta discharge holes 412 and 413 is adjusted according to the fastening force of the feces/urine adjusting bolts 412' and 413' fastened to the excreta discharge holes 412 and 413 or the compressive force of a filter (not shown) pressed by the fastening force of the feces/urine adjusting bolts 412' and 413' such that the amount of air flowing to the excreta discharge holes 412 and 413 is adjusted such that the flushing water is discharged to correspond to the feces/urine.

As the loading member 220 is restored while pressing the retaining member 620 of the opening and closing member 600, and is separated from the guide protrusion 523 of the wire guide 520 to release the wire guide 520, and in the state where the flushing water of the water tank is discharged to the toilet main body, the siphon cover 20 is moved downward to close the drain hole of the water tank, and simultaneously the released wire guide 520 pulls the flushing wire 540 by the downward movement of the siphon cover 20, and the flushing wire 540 rotates the wire roller 530 and restores the wire guide 520, and the restoring wire guide 520 is easily restored while rotating the auxiliary wire roller 530*a* fastened to the shaft 510*a*.

Further, by the downward movement of the air inlet regulator 420, the feces and urine determination pin 340 mounted to the determining pin-control groove 425*a* and the toilet paper time-check pin 430 mounted to the check pin-control groove 425*b* are moved downward by the pressure of the respective control grooves to open the guide rib through-hole 411' formed through the feces discharge hole 412 and the guide rib 410, and simultaneously the loading unit 200, the feces and urine distinguishing unit 300, and the toilet paper time and flush control unit 400 are restored and wait for the next operation.

Although the present invention was described above with reference to limitative embodiments and drawings, the terminologies and terms used in the specification and claims should not be construed as being limited to common or dictionary meanings, but should be construed as having meanings corresponding to the spirit of the present invention. Therefore, the configurations described in the embodiments and drawings of the present invention are merely most preferable embodiments but do not represent all of the technical spirit of the present invention. Thus, the present invention should be construed as including all the changes, equivalents, and substitutions without departing from the claims.

The invention claimed is:

1. An unpowered and automatically flushing toilet seat, for a water tank, having detachable and waterproof functions, the toilet seat comprising:

a seating switch (100) configured to guide downward movement of a toilet seat (10) by a sitting user's body weight, and to guide upward movement of the toilet seat (10) when the user stands up from the toilet seat (10) and the user's body weight is unloaded;

a loading unit (200) configured to press a loading member (220) in conjunction with the downward movement of the toilet seat (10) so as to obtain a loading force to pull a flushing wire (540) of an opening and closing member (500), and to pull the flushing wire (540) of the opening and closing member (500) in conjunction with the downward movement of the toilet seat (10) by the loading force of the restoring loading member (220) when the user's body weight is unloaded;

the opening and closing member (500) configured to supply flushing water of a water tank to a toilet main body through a drain hole opened while a siphon cover (20) is rotated upward by the flushing wire (540) pulled by the loading force of the loading member (220) to remove excreta, and to allow the siphon cover (20) being rotated downward to close the drain hole when the loading force of the loading member (220) is released; and a flushing-maintaining unit (600) configured to maintain operation of the opening and closing member (500) until set water is discharged while preventing abrupt restoration of the restoring loading member (220), wherein the loading unit (200) includes:

a loading shaft (210) protruding from a sensing plate (130) of the seating switch (100);

the loading member (220) mounted to the loading shaft (210), and configured to generate the loading force to pull the flushing wire (540) by being stopped by a guide protrusion (523) of a wire guide (520) while being rotated by being pressed by a loading lever (230) operating in conjunction with the downward movement of the toilet seat (10);

the loading lever (230) configured such that a second end thereof accommodates a side of the loading member (220) to press and rotate the loading member (220) and a first end thereof is rotatably mounted to a guide groove (230*a*) provided on the sensing plate (130); and a lever guide (240) mounted to a cover (120) to press the loading lever (230) while preventing the loading lever (230) from being separated from the guide groove (230*a*).

2. The toilet seat of claim 1, wherein the seating switch (100) includes:

the cover (120) mounted to a mounting hole (110) formed in the toilet seat (10), and configured such that a hook (131) protruding from the sensing plate (130) is coupled to a hook hole (121) formed therethrough;

the sensing plates (130) mounted to the toilet main body as the hook (131) is coupled to the hook hole (121) formed through the cover (120); and a seat spring (140) mounted between the cover (120) and the sensing plate (130).

3. The toilet seat of claim 2, further comprising:

a waterproof sheet (150) with the sensing plate (130) and the cover (120) surrounded thereby mounted to the mounting hole (110).

4. The toilet seat of claim 2, further comprising:

a mounting fixing unit (160) configured to fix the cover (120) to the mounting hole (110).

5. The toilet seat of claim 4, wherein the mounting fixing unit (160) includes:

a mounting fixing hole (161) grooved at a side of the cover (120);

a mounting spring (162) accommodated in the mounting fixing hole (161), and configured to press a mounting fixing member (163); and the mounting fixing member (163) mounted to the mounting fixing hole (161) and the toilet seat (10) by pressure of the mounting spring (162), and configured to prevent separation of the cover (120).

6. The toilet seat of claim 2, wherein the loading unit (200), or the loading unit (200) and the toilet paper time and flush control unit (400), or the loading unit (200), the feces and urine distinguishing unit (300) and the toilet paper time and flush control unit (400) are mounted between the cover (120) and the sensing plate (130) and modularized.

7. The toilet seat of claim 1, further comprising:

a loading-maintaining member (250) accommodating the loading member (220) rotated by pressure of the loading lever (230) to generate a loading force, and maintaining the loading force of the loading member (220) until the loading member (220) is separated therefrom.

8. The toilet seat of claim 7, wherein the loading-maintaining member (250) includes:

a loading-maintaining body (251) provided with an inclined stop protrusion (251*a*) protruding therefrom such that the loading member (220) is moved and stopped thereby; and a control spring (252) configured to support the loading-maintaining body (251).

9. The toilet seat of claim 1, wherein the opening and closing member (500) includes:

a rotation guide shaft (510) protruding from the toilet seat (10);

the wire guide (520) configured to be rotated to pull the flushing wire (540) by the loading force of the loading member (220) stopped by the guide protrusion (523) of the wire guide (520) as the rotation guide shaft (510) is mounted to a shaft hole (521);

a wire roller (530) rotatably mounted to a roller guide hole (522) formed in the wire guide (520) to guide the flushing wire (540); and the flushing wire (540) configured to connect the siphon cover (20) and the toilet seat (10) via the wire roller (530).

10. The toilet seat of claim 9, further comprising:

an auxiliary wire roller (530*a*) mounted to a rotation guide shaft (510*a*) protruding from the toilet seat (10) to guide rotation of the wire guide (520).

11. The toilet seat of claim 1, wherein the flushing-maintaining unit (600) includes:

a rotation guide shaft (610) protruding from the toilet seat (10); and a retaining member (620) mounted to the rotation guide shaft (610), and configured to delay a restoration time by absorbing the restoring force of the restoring loading member (220).

12. The toilet seat of claim 11, wherein the retaining member (620) includes:

a retaining body (621) configured such that the rotation guide shaft (610) is mounted to a shaft hole (622); and an elastic piece (623) protruding from an end portion of the retaining body (621), and absorbing the restoring force of the loading member (220) and supporting the same by being brought into close contact with an inner surface of the toilet seat (10).

13. An unpowered and automatically flushing toilet seat, for a water tank, having detachable and waterproof functions, the toilet seat comprising:

a seating switch (100) configured to guide downward movement of a toilet seat (10) by a sitting user's body weight, and to guide upward movement of the toilet seat (10) when the user stands up from the toilet seat (10) and the user's body weight is unloaded;

a loading unit (200) configured to press a loading member (220) in conjunction with the downward movement of the toilet seat (10) so as to obtain a loading force to pull a flushing wire (540) of an opening and closing member (500), and to pull the flushing wire (540) of the opening and closing member (500) in conjunction with the downward movement of the toilet seat (10) by the loading force of the restoring loading member (220) when the user's body weight is unloaded;

a toilet paper time and flush control unit (400) configured to discharge air inside a guide rib (410) as an air inlet regulator (420) operating in conjunction with the downward movement of the toilet seat (10) is moved upward, and to adjust an amount of air flowing in the guide rib (410) as the air inlet regulator (420) operating in conjunction with the upward movement of the toilet seat (10) is moved downward when the user's body weight is unloaded, thereby controlling user's toilet paper-disposal time and flushing;

the opening and closing member (500) configured to supply flushing water of a water tank to a toilet main body through a drain hole opened while a siphon cover (20) is rotated upward by the flushing wire (540) pulled by the loading force of the loading member (220) to remove excreta, and to allow the siphon cover (20) being rotated downward to close the drain hole when the loading force of the loading member (220) is released; and a flushing-maintaining unit (600) configured to maintain operation of the opening and closing member (500) until set water is discharged while preventing abrupt restoration of the restoring loading member (220), wherein the loading unit (200) includes:

a loading shaft (210) protruding from a sensing plate (130) of the seating switch (100);

the loading member (220) mounted to the loading shaft (210), and configured to generate the loading force to pull the flushing wire (540) by being stopped by a guide protrusion (523) of a wire guide (520) while being rotated by being pressed by a loading lever (230) operating in conjunction with the downward movement of the toilet seat (10);

the loading lever (230) configured such that a second end thereof accommodates a side of the loading member (220) to press and rotate the loading member (220) and a first end thereof is rotatably mounted to a guide groove (230*a*) provided on the sensing plate (130); and a lever guide (240) mounted to a cover (120) to press the loading lever (230) while preventing the loading lever (230) from being separated from the guide groove (230*a*).

14. The toilet seat of claim 13, wherein the seating switch (100) includes:

the cover (120) mounted to a mounting hole (110) formed in the toilet seat (10), and configured such that a hook (131) protruding from the sensing plate (130) is coupled to a hook hole (121) formed therethrough;

the sensing plates (130) mounted to the toilet main body as the hook (131) is coupled to the hook hole (121) formed through the cover (120); and a seat spring (140) mounted between the cover (120) and the sensing plate (130).

15. The toilet seat of claim 14, further comprising:

a waterproof sheet (150) with the sensing plate (130) and the cover (120) surrounded thereby mounted to the mounting hole (110).

16. The toilet seat of claim 14, further comprising:

a mounting fixing unit (160) configured to fix the cover (120) to the mounting hole (110).

17. The toilet seat of claim 16, wherein the mounting fixing unit (160) includes:

a mounting fixing hole (161) grooved at a side of the cover (120);

a mounting spring (162) accommodated in the mounting fixing hole (161), and configured to press a mounting fixing member (163); and the mounting fixing member (163) mounted to the mounting fixing hole (161) and the toilet seat (10) by pressure of the mounting spring (162), and configured to prevent separation of the cover (120).

18. The toilet seat of claim 14, wherein the loading unit (200), or the loading unit (200) and the toilet paper time and flush control unit (400), or the loading unit (200), the feces and urine distinguishing unit (300) and the toilet paper time and flush control unit (400) are mounted between the cover (120) and the sensing plate (130) and modularized.

19. The toilet seat of claim 13, further comprising:

a loading-maintaining member (250) accommodating the loading member (220) rotated by pressure of the loading lever (230) to generate a loading force, and maintaining the loading force of the loading member (220) until the loading member (220) is separated therefrom.

20. The toilet seat of claim 19, wherein the loading-maintaining member (250) includes:

a loading-maintaining body (251) provided with an inclined stop protrusion (251*a*) protruding therefrom such that the loading member (220) is moved and stopped thereby; and a control spring (252) configured to support the loading-maintaining body (251).

21. The toilet seat of claim 13, wherein the opening and closing member (500) includes:

a rotation guide shaft (510) protruding from the toilet seat (10);

the wire guide (520) configured to be rotated to pull the flushing wire (540) by the loading force of the loading member (220) stopped by the guide protrusion (523) of the wire guide (520) as the rotation guide shaft (510) is mounted to a shaft hole (521);

a wire roller (530) rotatably mounted to a roller guide hole (522) formed in the wire guide (520) to guide the flushing wire (540); and the flushing wire (540) configured to connect the siphon cover (20) and the toilet seat (10) via the wire roller (530).

22. The toilet seat of claim 21, further comprising:

an auxiliary wire roller (530*a*) mounted to a rotation guide shaft (510*a*) protruding from the toilet seat (10) to guide rotation of the wire guide (520).

23. The toilet seat of claim 13, wherein the flushing-maintaining unit (600) includes:

a rotation guide shaft (610) protruding from the toilet seat (10); and a retaining member (620) mounted to the rotation guide shaft (610), and configured to delay a restoration time by absorbing the restoring force of the restoring loading member (220).

24. The toilet seat of claim 23, wherein the retaining member (620) includes:

a retaining body (621) configured such that the rotation guide shaft (610) is mounted to a shaft hole (622); and an elastic piece (623) protruding from an end portion of the retaining body (621), and absorbing the restoring force of the loading member (220) and supporting the same by being brought into close contact with an inner surface of the toilet seat (10).

25. The toilet seat of claim 13, wherein the toilet paper time and flush control unit (400) includes:

a guide rib (410) configured to protrude from the cover (120) of the seating switch (100) such that an inlet check valve (410*a*) opens and closes a discharge through-hole (411) formed therethrough, and formed with an excreta discharge holes (412 and 413) at a side thereof with which feces/urine adjusting bolts (412' and 413') are engaged;

an air inlet regulator (420) accommodated in the guide rib (410), and configured such that air in the guide rib (410) is discharged by the inlet check valve (410*a*) opened in conjunction with the downward movement of the toilet seat (10), and the amount of air flowing in the guide rib (410) is regulated by closing the inlet check valve (410*a*) in conjunction with the upward movement of the toilet seat (10);

a toilet paper time-check pin (430) mounted to a check pin-control groove (425*b*) formed in the air inlet regulator (420), and configured to open and close a guide rib through-hole (411') formed through the guide rib (410) while being vertically moved along the air inlet regulator (420) to secure a time for the user to discard toilet paper; and an unloading guide member (440) configured to release a supporting force of the loading-maintaining member (250) of the loading unit (200) as the air inlet regulator (420) is vertically moved in the guide rib (410) to press an unloading member (450) provided in the air inlet regulator (420).

26. The toilet seat of claim 25, wherein the air inlet regulator (420) includes:

an air inlet regulating member (421) configured to be vertically moved in the guide rib (410);

a seat cover (422) seated on an upper surface of the air inlet regulating member (421);

through-holes (422*a* and 421*a*) formed through the seat cover (422) and the air inlet regulating member (421) to be coupled with the inlet check valve (410*a*);

a flush washer (423) mounted to the air inlet regulating member (421) and configured to support an adjusting spring (424);

the adjusting spring (424) mounted to the air inlet regulating member (421) to be brought into close contact with the flush washer (423);

an anti-separation member (425) mounted to a lower end portion of the air inlet regulating member (421) to prevent separation of the adjusting spring (424), configured to compress the adjusting spring (424) in conjunction with the downward movement of the toilet seat (10), and provided with a determining pin-control groove (425*a*) and the check pin-control groove (425*b*) on an outer circumferential surface thereof; and an inflow-adjusting bolt (426) fastened to the through-hole (421*a*) of the air inlet regulating member (421) to guide air flow.

27. The toilet seat of claim 26, further comprising:

an adjustment filter (427) configured to guide the air flow by being pressed by a fastening force of the inflow-adjusting bolt (426) fastened to the through-hole (421*a*) of the air inlet regulating member (421); and a fine adjustment filter (427*a*) accommodated in the inflow-adjusting bolt (426), and configured to filter foreign substances.

28. The toilet seat of claim 25, wherein the unloading guide member (440) includes:

an unloading guide body (441) rotatably mounted to a coupling hole (440*a*) formed in the cover (120);

an unloading control protrusion (442) protruding from a first side of the unloading guide body (441) to be selectively stopped by a loading-maintaining control protrusion (251*b*) of the loading-maintaining member (250);

an unloading guide protrusion (443) protruding from a second side of the unloading guide body (441) at an obtuse angle with respect to the unloading control protrusion (442) to press the unloading member (450); and a restoring elastic piece (444) protruding from the first side of the unloading guide body (441) to be brought into close contact with an inner surface of the toilet seat (10), thereby restoring the unloading guide body (441) with pressure of the unloading member (450) released.

29. An unpowered and automatically flushing toilet seat, for a water tank, having detachable and waterproof functions, the toilet seat comprising:

a seating switch (100) configured to guide downward movement of a toilet seat (10) by a sitting user's body weight, and to guide upward movement of the toilet seat (10) when the user stands up from the toilet seat (10) and the user's body weight is unloaded;

a loading unit (200) configured to press a loading member (220) in conjunction with the downward movement of the toilet seat (10) so as to obtain a loading force to pull a flushing wire (540) of an opening and closing member (500), and to pull the flushing wire (540) of the opening and closing member (500) in conjunction with the downward movement of the toilet seat (10) by the loading force of the restoring loading member (220) when the user's body weight is unloaded;

a feces and urine distinguishing unit (300) configured to adjust a discharge amount of air inside a distinguishing-guide rib (310) as a guide rod (330) operating in conjunction with the downward movement of the toilet seat (10) is moved in the distinguishing-guide rib (310), such that when a feces and urine determination member (340*a*) fails to press a feces and urine determination pin (340), user's excreta is determined as urine, and when the feces and urine determination member (340*a*) presses the feces and urine determination pin (340), user's excreta is determined as feces;

a toilet paper time and flush control unit (400) configured to discharge air inside a guide rib (410) as an air inlet regulator (420) operating in conjunction with the downward movement of the toilet seat (10) is moved upward, and to adjust an amount of air flowing in the guide rib (410) as the air inlet regulator (420) operating in conjunction with the upward movement of the toilet seat (10) is moved downward when the user's body weight is unloaded, thereby controlling user's toilet paper-disposal time and flushing;

the opening and closing member (500) configured to supply flushing water of a water tank to a toilet main body through a drain hole opened while a siphon cover (20) is rotated upward by the flushing wire (540) pulled by the loading force of the loading member (220) to remove excreta, and to allow the siphon cover (20) being rotated downward to close the drain hole when the loading force of the loading member (220) is released; and a flushing-maintaining unit (600) configured to maintain operation of the opening and closing member (500) until set water is discharged while preventing abrupt restoration of the restoring loading member (220).

30. The toilet seat of claim 29, wherein the seating switch (100) includes:

the cover (120) mounted to a mounting hole (110) formed in the toilet seat (10), and configured such that a hook (131) protruding from the sensing plate (130) is coupled to a hook hole (121) formed therethrough;

the sensing plates (130) mounted to the toilet main body as the hook (131) is coupled to the hook hole (121) formed through the cover (120); and a seat spring (140) mounted between the cover (120) and the sensing plate (130).

31. The toilet seat of claim 30, further comprising:

a waterproof sheet (150) with the sensing plate (130) and the cover (120) surrounded thereby mounted to the mounting hole (110).

32. The toilet seat of claim 30, further comprising:

a mounting fixing unit (160) configured to fix the cover (120) to the mounting hole (110).

33. The toilet seat of claim 32, wherein the mounting fixing unit (160) includes:

a mounting fixing hole (161) grooved at a side of the cover (120);

a mounting spring (162) accommodated in the mounting fixing hole (161), and configured to press a mounting fixing member (163); and the mounting fixing member (163) mounted to the mounting fixing hole (161) and the toilet seat (10) by pressure of the mounting spring (162), and configured to prevent separation of the cover (120).

34. The toilet seat of claim 30, wherein the loading unit (200), or the loading unit (200) and the toilet paper time and flush control unit (400), or the loading unit (200), the feces and urine distinguishing unit (300) and the toilet paper time and flush control unit (400) are mounted between the cover (120) and the sensing plate (130) and modularized.

35. The toilet seat of claim 29, wherein the loading unit (200) includes:

a loading shaft (210) protruding from a sensing plate (130) of the seating switch (100);

the loading member (220) mounted to the loading shaft (210), and configured to generate the loading force to pull the flushing wire (540) by being stopped by a guide protrusion (523) of a wire guide (520) while being rotated by being pressed by a loading lever (230) operating in conjunction with the downward movement of the toilet seat (10);

the loading lever (230) configured such that a second end thereof accommodates a side of the loading member (220) to press and rotate the loading member (220) and a first end thereof is rotatably mounted to a guide groove (230*a*) provided on the sensing plate (130); and a lever guide (240) mounted to a cover (120) to press the loading lever (230) while preventing the loading lever (230) from being separated from the guide groove (230*a*).

36. The toilet seat of claim 35, further comprising:

a loading-maintaining member (250) accommodating the loading member (220) rotated by pressure of the loading lever (230) to generate a loading force, and maintaining the loading force of the loading member (220) until the loading member (220) is separated therefrom.

37. The toilet seat of claim 36, wherein the loading-maintaining member (250) includes:

a loading-maintaining body (251) provided with an inclined stop protrusion (251*a*) protruding therefrom such that the loading member (220) is moved and stopped thereby; and a control spring (252) configured to support the loading-maintaining body (251).

38. The toilet seat of claim 29, wherein the opening and closing member (500) includes:

a rotation guide shaft (510) protruding from the toilet seat (10);

the wire guide (520) configured to be rotated to pull the flushing wire (540) by the loading force of the loading member (220) stopped by the guide protrusion (523) of the wire guide (520) as the rotation guide shaft (510) is mounted to a shaft hole (521);

a wire roller (530) rotatably mounted to a roller guide hole (522) formed in the wire guide (520) to guide the flushing wire (540); and the flushing wire (540) configured to connect the siphon cover (20) and the toilet seat (10) via the wire roller (530).

39. The toilet seat of claim 38, further comprising:

an auxiliary wire roller (530*a*) mounted to a rotation guide shaft (510*a*) protruding from the toilet seat (10) to guide rotation of the wire guide (520).

40. The toilet seat of claim 29, wherein the flushing-maintaining unit (600) includes:

a rotation guide shaft (610) protruding from the toilet seat (10); and a retaining member (620) mounted to the rotation guide shaft (610), and configured to delay a restoration time by absorbing the restoring force of the restoring loading member (220).

41. The toilet seat of claim 40, wherein the retaining member (620) includes:

a retaining body (621) configured such that the rotation guide shaft (610) is mounted to a shaft hole (622); and an elastic piece (623) protruding from an end portion of the retaining body (621), and absorbing the restoring force of the loading member (220) and supporting the same by being brought into close contact with an inner surface of the toilet seat (10).

42. The toilet seat of claim 29, wherein the toilet paper time and flush control unit (400) includes:

a guide rib (410) configured to protrude from the cover (120) of the seating switch (100) such that an inlet check valve (410*a*) opens and closes a discharge through-hole (411) formed therethrough, and formed with an excreta discharge holes (412 and 413) at a side thereof with which feces/urine adjusting bolts (412' and 413') are engaged;

an air inlet regulator (420) accommodated in the guide rib (410), and configured such that air in the guide rib (410) is discharged by the inlet check valve (410*a*) opened in conjunction with the downward movement of the toilet seat (10), and the amount of air flowing in the guide rib (410) is regulated by closing the inlet check valve (410*a*) in conjunction with the upward movement of the toilet seat (10);

a toilet paper time-check pin (430) mounted to a check pin-control groove (425*b*) formed in the air inlet regulator (420), and configured to open and close a guide rib through-hole (411') formed through the guide rib (410) while being vertically moved along the air inlet regulator (420) to secure a time for the user to discard toilet paper; and an unloading guide member (440) configured to release a supporting force of the loading-maintaining member (250) of the loading unit (200) as the air inlet regulator (420) is vertically moved in the guide rib (410) to press an unloading member (450) provided in the air inlet regulator (420).

43. The toilet seat of claim 42, wherein the air inlet regulator (420) includes:

an air inlet regulating member (421) configured to be vertically moved in the guide rib (410);

a seat cover (422) seated on an upper surface of the air inlet regulating member (421);

through-holes (422*a* and 421*a*) formed through the seat cover (422) and the air inlet regulating member (421) to be coupled with the inlet check valve (410*a*);

a flush washer (423) mounted to the air inlet regulating member (421) and configured to support an adjusting spring (424);

the adjusting spring (424) mounted to the air inlet regulating member (421) to be brought into close contact with the flush washer (423);

an anti-separation member (425) mounted to a lower end portion of the air inlet regulating member (421) to prevent separation of the adjusting spring (424), configured to compress the adjusting spring (424) in conjunction with the downward movement of the toilet seat (10), and provided with a determining pin-control groove (425*a*) and the check pin-control groove (425*b*) on an outer circumferential surface thereof; and an inflow-adjusting bolt (426) fastened to the through-hole (421*a*) of the air inlet regulating member (421) to guide air flow.

44. The toilet seat of claim 43, further comprising:

an adjustment filter (427) configured to guide the air flow by being pressed by a fastening force of the inflow-adjusting bolt (426) fastened to the through-hole (421*a*) of the air inlet regulating member (421); and a fine adjustment filter (427*a*) accommodated in the inflow-adjusting bolt (426), and configured to filter foreign substances.

45. The toilet seat of claim 42, wherein the unloading guide member (440) includes:

an unloading guide body (441) rotatably mounted to a coupling hole (440*a*) formed in the cover (120);

an unloading control protrusion (442) protruding from a first side of the unloading guide body (441) to be selectively stopped by a loading-maintaining control protrusion (251*b*) of the loading-maintaining member (250);

an unloading guide protrusion (443) protruding from a second side of the unloading guide body (441) at an obtuse angle with respect to the unloading control protrusion (442) to press the unloading member (450); and a restoring elastic piece (444) protruding from the first side of the unloading guide body (441) to be brought into close contact with an inner surface of the toilet seat (10), thereby restoring the unloading guide body (441) with pressure of the unloading member (450) released.

46. The toilet seat of claim 29, wherein the feces and urine distinguishing unit (300) includes:

a distinguishing-guide rib (310) protruding from a cover (120) of the seating switch (100), with an inlet through-hole (311) formed therethrough;

a discharge check valve (320) configured to open and close the inlet through-hole (311) of the distinguishing-guide rib (310);

a guide rod (330) accommodated in the distinguishing-guide rib (310), and configured to discharge air in the distinguishing-guide rib (310) to a guide through-hole (330*a*) while being moved by pressure of a guide spring (330') in conjunction with the downward movement of the toilet seat (10);

a feces and urine determination pin (340) mounted to a determining pin-control groove (425*a*) of the air inlet regulator (420), and configured to determine whether excreta is feces or urine in accordance with opening and closing of a urine discharge hole (413) by pressure of the feces and urine determination member (340*a*) protruding from a side of the guide rod (330); and a discharge adjusting bolt (350) fastened to the guide through-hole (330*a*) to control air flow discharged through the guide through-hole (330*a*).

47. The toilet seat of claim 46, further comprising:

an adjustment filter (360) configured to guide the air flow by being pressed by a fastening force of the discharge adjusting bolt (350) fastened to the guide through-hole (330*a*) of the guide rod (330).

* * * * *